US009753400B2

(12) United States Patent
Sato

(10) Patent No.: US 9,753,400 B2
(45) Date of Patent: Sep. 5, 2017

(54) DEVELOPER CARTRIDGE AND DEVELOPING UNIT PROVIDED WITH THE SAME

(71) Applicant: Brother Kogyo Kabushiki Kaisha, Nagoya-shi, Aichi-ken (JP)

(72) Inventor: Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/171,715

(22) Filed: Jun. 2, 2016

(65) Prior Publication Data

US 2016/0274496 A1 Sep. 22, 2016

Related U.S. Application Data

(63) Continuation of application No. 14/093,816, filed on Dec. 2, 2013, now Pat. No. 9,366,993, which is a (Continued)

(30) Foreign Application Priority Data

Apr. 28, 2009 (JP) ..... 2009-109614
Apr. 28, 2009 (JP) ..... 2009-109622

(51) Int. Cl.
*G03G 15/00* (2006.01)
*G03G 15/08* (2006.01)

(52) U.S. Cl.
CPC ..... *G03G 15/0865* (2013.01); *G03G 15/0844* (2013.01); *G03G 15/0855* (2013.01); (Continued)

(58) Field of Classification Search
CPC ..... G03G 15/0865; G03G 15/0886; G03G 15/0872; G03G 15/0877; G03G 21/1676
(Continued)

(56) References Cited

U.S. PATENT DOCUMENTS 5,235,389 A 8/1993 Kikuchi et al.
5,325,163 A 6/1994 Nishio
(Continued)

FOREIGN PATENT DOCUMENTS

JP H06-035321 A 2/1994
JP H0635321 A 2/1994
(Continued)

OTHER PUBLICATIONS

Final Office Actionreceived in U.S. Appl. No. 12/767,314 mailed Apr. 2, 2013.

(Continued)

*Primary Examiner* — Walter L Lindsay, Jr.
*Assistant Examiner* — Jessica L Eley
(74) *Attorney, Agent, or Firm* — Banner & Witcoff, Ltd.

(57) ABSTRACT

A developer cartridge assembled to a developing device defining therein a developing chamber. The developer cartridge includes a first accommodating portion, and a first agitator. The first accommodating portion accommodates therein a developing agent and is positioned beside the developing device. The first accommodating portion includes a first wall part neighboring the developing device. The first wall part is formed with a first through-hole and a second through-hole. The first through-hole is open diagonally downward from the first accommodating portion to the developing device. The second through-hole is open diagonally upward from the first accommodating portion to the developing device. The first through-hole and the second through-hole allow communication between an interior of the first accommodating portion and the developing chamber. The first agitator is rotatably disposed in the first accommodating portion and in sliding contact with the first wall part in a vertical direction.

9 Claims, 17 Drawing Sheets

Related U.S. Application Data continuation of application No. 12/767,314, filed on Apr. 26, 2010, now Pat. No. 8,600,267.

(52) U.S. Cl.
CPC ..... *G03G 15/0875* (2013.01); *G03G 15/0886* (2013.01); *G03G 15/0889* (2013.01); *G03G 15/0893* (2013.01); *G03G 2215/085* (2013.01); *G03G 2215/0819* (2013.01); *G03G 2215/0872* (2013.01)

(58) Field of Classification Search
USPC ..... 399/254
See application file for complete search history.

(56) References Cited

U.S. PATENT DOCUMENTS

| | | | | |
|---|---|---|---|---|
| 6,185,401 | B1 | 2/2001 | Kanamori et al. | |
| 7,734,231 | B2 | 6/2010 | Eto et al. | |
| 7,826,779 | B2 | 11/2010 | Mase et al. | |
| 7,953,351 | B2 | 5/2011 | Isomura et al. | |
| 7,983,590 | B2 | 7/2011 | Sakuma | |
| 8,526,862 | B2 | 9/2013 | Sato | |
| 8,532,543 | B2 | 9/2013 | Sato | |
| 8,862,034 | B2 | 10/2014 | Sato | |
| 8,862,035 | B2 | 10/2014 | Sato | |
| 9,146,532 | B2 | 9/2015 | Sato | |
| 9,348,306 | B2 | 5/2016 | Sato | |
| 2006/0193652 | A1 | 8/2006 | Sato | |
| 2007/0065184 | A1 | 3/2007 | Sato | |
| 2007/0122175 | A1 | 5/2007 | Sato | |
| 2007/0189811 | A1 | 8/2007 | Sato | |
| 2008/0025758 | A1 | 1/2008 | Sato | |
| 2008/0075506 | A1* | 3/2008 | Sato | G03G 15/0872 399/262 |
| 2008/0175627 | A1 | 7/2008 | Sato | |
| 2008/0279595 | A1 | 11/2008 | Uezono | |
| 2008/0292331 | A1 | 11/2008 | Yokomori et al. | |
| 2008/0298837 | A1 | 12/2008 | Mase | |
| 2009/0087215 | A1 | 4/2009 | Sakuma | |
| 2009/0087227 | A1 | 4/2009 | Takagi et al. | |
| 2009/0274491 | A1 | 11/2009 | Sato | |
| 2011/0158698 | A1 | 6/2011 | Sato | |
| 2016/0266540 | A1 | 9/2016 | Sato | |

FOREIGN PATENT DOCUMENTS

| | | | |
|---|---|---|---|
| JP | H06-148968 | A | 5/1994 |
| JP | H08240976 | A | 9/1996 |
| JP | H10-239969 | A | 9/1998 |
| JP | 2005-326869 | A | 11/2005 |
| JP | 2007-086324 | A | 4/2007 |
| JP | 2007086622 | A | 4/2007 |
| JP | 2007-212966 | A | 8/2007 |
| JP | 2008191578 | A | 8/2008 |
| JP | 2008203830 | A | 9/2008 |
| JP | 2008216454 | A | 9/2008 |
| JP | 2008233862 | A | 10/2008 |
| JP | 2009-086505 | A | 4/2009 |
| JP | 2009-265537 | A | 11/2009 |
| JP | 2009-271099 | A | 11/2009 |

OTHER PUBLICATIONS

Notice of Allowance issued in corresponding U.S. Appl. No. 12/767,314 mailed Jul. 22, 2013.
Decision of Rejection issued in corresponding Chinese Patent Application No. 201010174397.8 mailed Aug. 30, 2012.
The First Office Action for Chinese patent application No. 201010174397.8 mailed Dec. 12, 2011.
Japanese Office Action mailed Jan. 25, 2011 in Japanese Application No. 2009-109614 and English Translation thereof.
Dec. 24, 2014—(US) Non-final Office Action—U.S. Appl. No. 14/093,816.
Jul. 27, 2015—(US) Final Office Action—U.S. Appl. No. 14/093,816.
Mar. 1, 2016—(US) Notice of Allowance—U.S. Appl. No. 14/093,816.
Sep. 20, 2011—(JP) Decision to Grant a Patent—App 2009-294200.
Jan. 31, 2012—(JP) Decision to Grant a Patent—App 2010-015307.

* cited by examiner

102B1
102a
51A
S101A
S102b
33A
102c1
105C
142
RIGHT
REAR
FRONT
LEFT
102B2
S101B
102c2

102B1
102a
S101B
102b
51A
102c1
102c2
S101A
105C
142
102B2
102a
102b
102c2
S101B

DEVELOPER CARTRIDGE AND DEVELOPING UNIT PROVIDED WITH THE SAME

CROSS REFERENCE TO RELATED APPLICATIONS

This application is a continuation of U.S. patent application Ser. No. 14/093,816, filed on Dec. 2, 2013, which is a continuation of U.S. patent application Ser. No. 12/767,314 filed on Apr. 26, 2010, now U.S. Pat. No. 8,600,267, which claims priorities from Japanese Patent Application Nos. 2009-109614 filed Apr. 28, 2009, and 2009-109622 filed Apr. 28, 2009. The entire content of each of the above noted applications is incorporated herein by reference.

TECHNICAL FIELD

The present invention relates to a developer cartridge that supplies a developer (developing agent or toner) to a developing device. The present invention also relates to a developing unit having the developer cartridge.

BACKGROUND

An image forming device includes a developing device provided with a developing roller that carries the developer, and a developer cartridge assembled to the developing device in a horizontal direction. The developer cartridge includes an accommodating portion that accommodates therein the developer and juxtaposed with the developing device in the horizontal direction, and an agitator rotatably disposed in the accommodating portion. The accommodating portion has a wall portion adjacent to the developing device, and a single opening is formed in the wall portion at a widthwise center portion thereof (axially intermediate portion of the developing roller).

The agitator is slidingly moved relative to the wall portion so that the agitator is moved past the opening upward. The agitator lifts the toner deposited on a bottom of the accommodating portion, and pushes the toner into the developing device through the opening. Thus, the toner is supplied from the accommodating portion to the developing device.

SUMMARY

With this structure, toner may not be easily returned from the developing device to the accommodating portion, since only a single opening is formed. Therefore, degraded toner in the developing device may remain therein.

In view of the foregoing, it is an object of the invention to provide the developer cartridge and a developing unit having the developer cartridge capable of enhancing toner recirculation between the developing device and the developer cartridge.

In order to attain the above and other objects, the invention provides a developer cartridge detachably assembled to a developing device defining therein a developing chamber, the developer cartridge including a first accommodating portion and a first agitator. The first accommodating portion accommodates therein a developing agent and is positioned beside the developing device as a result of the assembly to the developing device. The first accommodating portion has a first wall part neighboring the developing device and protruding toward an interior of the first accommodating portion. The first wall part has a first wall region formed with a first through-hole allowing communication between an interior of the first accommodating portion and the developing chamber, an intermediate wall region, and a second wall region formed with a second through-hole allowing communication between the interior of the first accommodating portion and the developing chamber. The first agitator defines a rotation axis and is rotatably disposed in the first accommodating portion and in sliding contact with the first wall part in an order from the first wall region, the intermediate wall region, and the second wall region. The first wall region is sloped toward the rotation axis such that passing of the developing agent carried on the first agitator through the first through-hole is facilitated, The intermediate wall portion is positioned closer to the rotation axis than the first wall region and the second wall region to the rotation axis. The second wall region is sloped toward the rotation axis.

In another aspect of the invention, there is provided, a developing unit including a developing device defining therein a developing chamber, and a developer cartridge detachably assembled to the developing device. The developer cartridge includes a first accommodating portion, and a first agitator. The first accommodating portion accommodates therein a developing agent and is positioned horizontally beside the developing device as a result of the assembly to the developing device. The first accommodating portion has a first wall part neighboring the developing device, and the first wall part is formed with a first through-hole and a second through-hole. The first through-hole is open diagonally downward from the first accommodating portion to the developing device allowing communication between an interior of the first accommodating portion and the developing chamber. The second through-hole is open diagonally upward from the first accommodating portion to the developing device allowing communication between the interior of the first accommodating portion and the developing chamber. The first through-hole is positioned higher than the second through-hole. The first agitator is rotatably disposed in the first accommodating portion and in sliding contact with the first wall part in a vertical direction. The first agitator has a rotation shaft defining an axial direction and rotatable in a rotating direction. The first wall part protrudes toward the interior of the first accommodating portion and includes an upper wall region, a lower wall region, and a vertically intermediate wall region. The upper wall region is sloping downward from its uppermost end toward the interior of the first accommodating portion and formed with the first through-hole. The lower wall region is sloping upward from its lowermost end toward the interior of the first accommodating portion and formed with the second through-hole. The vertically intermediate wall region is provided at a joining portion between the upper wall region and the lower wall region and is positioned closer to the rotation shaft than the upper wall region and the lower wall region to the rotation shaft. The developing device includes a case wall part having a shape in conformance with that of the first wall part and positioned in confrontation with the first wall part. The case wall part is formed with a third through-hole at a position in confrontation with the first through-hole, and a fourth through-hole at a position in confrontation with the second through-hole.

In still another aspect of the invention, there is provided an image forming device for forming an image on a recording medium defining a widthwise direction, the image forming device including a main frame, and a process cartridge. The main frame has a first guide wall section and a second guide wall section spaced away therefrom in the widthwise direction. The process cartridge is detachably attached to the main frame, and includes a drum cartridge and a developing unit. The drum cartridge is assembled to the main frame through the first guide wall section and the second guide wall section. The developing unit is assembled to the drum cartridge and includes a developing device defining therein a developing chamber, and a developer cartridge detachably assembled to the developing device. The developer cartridge includes a first accommodating portion, a first agitator, and a first shutter. The first accommodating portion accommodates therein a developing agent and is positioned horizontally beside the developing device as a result of the assembly to the developing device. The first accommodating portion has a first wall part neighboring the developing device, and the first wall part is formed with a first through-hole and a second through-hole. The first through-hole is open diagonally downward from the first accommodating portion to the developing device allowing communication between an interior of the first accommodating portion and the developing chamber. The second through-hole is open diagonally upward from the first accommodating portion to the developing device allowing communication between the interior of the first accommodating portion and the developing chamber. The first through-hole is positioned higher than the second through-hole. The first agitator is rotatably disposed in the first accommodating portion and in sliding contact with the first wall part in a vertical direction. The first agitator has a rotation shaft defining an axial direction and rotatable in a rotating direction. The first shutter is slidingly movable along the first wall part. The developing device includes a case wall part and a second shutter. The case wall part has a shape in conformance with that of the first wall part and is positioned in confrontation with the first wall part. The case wall part is formed with a third through-hole at a position in confrontation with the first through-hole, and a fourth through-hole at a position in confrontation with the second through-hole. The second shutter is movable along the case wall part to selectively open and close the third through-hole and the fourth through-hole. The second shutter is moved in interlocking relation to a movement of the first shutter.

BRIEF DESCRIPTION OF THE DRAWINGS

In the drawings:

FIG. 4(*b*) is a view for description of open state of through-holes in the developer cartridge according to the first embodiment;

FIG. 9(*b*) is a view for description of an open state of the shutters in the developing unit according to the first embodiment;

FIG. 14(*b*) is a side view of a side wall of the drum cartridge according to the second embodiment of the invention;

FIG. 14(*c*) is a side view of the process cartridge according to the second embodiment of the invention;

FIG. 15(*b*) is a side view of the developer cartridge according to the second embodiment of the invention;

FIG. 15(*c*) is another side view of the developer cartridge according to the second embodiment and particularly showing a gear train similar to FIG. 3;

FIG. 16(*b*) is a side view of the developing device according to the second embodiment of the invention;

FIG. 17(*b*) is the front view of the second shutter as viewed in the direction of the arrow D2 in FIG. 16(*a*) and particularly showing a closed state of the third and fourth through-holes according to the second embodiment of the invention;

FIG. 18(*b*) is a front view of the first shutter as viewed in the direction of the arrow D1 in FIG. 15(*a*) and particularly showing a closed state of the first and second through-holes according to the second embodiment of the invention;

FIG. 19(*b*) is a view for description of movement of the first shutter and showing a state where the process cartridge is moved rearward from the state shown in FIG. 19(*a*) according to the second embodiment;

FIG. 19(*c*) is a view for description of movement of the first shutter and showing a state where the process cartridge is further moved rearward from the state shown in FIG. 19(*b*) according to the second embodiment;

FIG. 19(*d*) is a view for description of movement of the first shutter and showing a state where the process cartridge is fully inserted into the main frame in the laser printer according to the second embodiment;

FIG. 20(*b*) is a side view of a developing device according to a modification to the second embodiment.

DETAILED DESCRIPTION

A developer cartridge and a developing unit provided with the developer cartridge according to a first embodiment of the invention will be described with reference to the accompanying drawings. The following description pertains to a laser printer in which the developing unit is installed. The terms "upward", "downward", "upper", "lower", "above", "below", "beneath", "right", "left", "front", "rear" and the like will be used throughout the description assuming that the laser printer is disposed in an orientation in which it is intended to be used.

Figure 1:
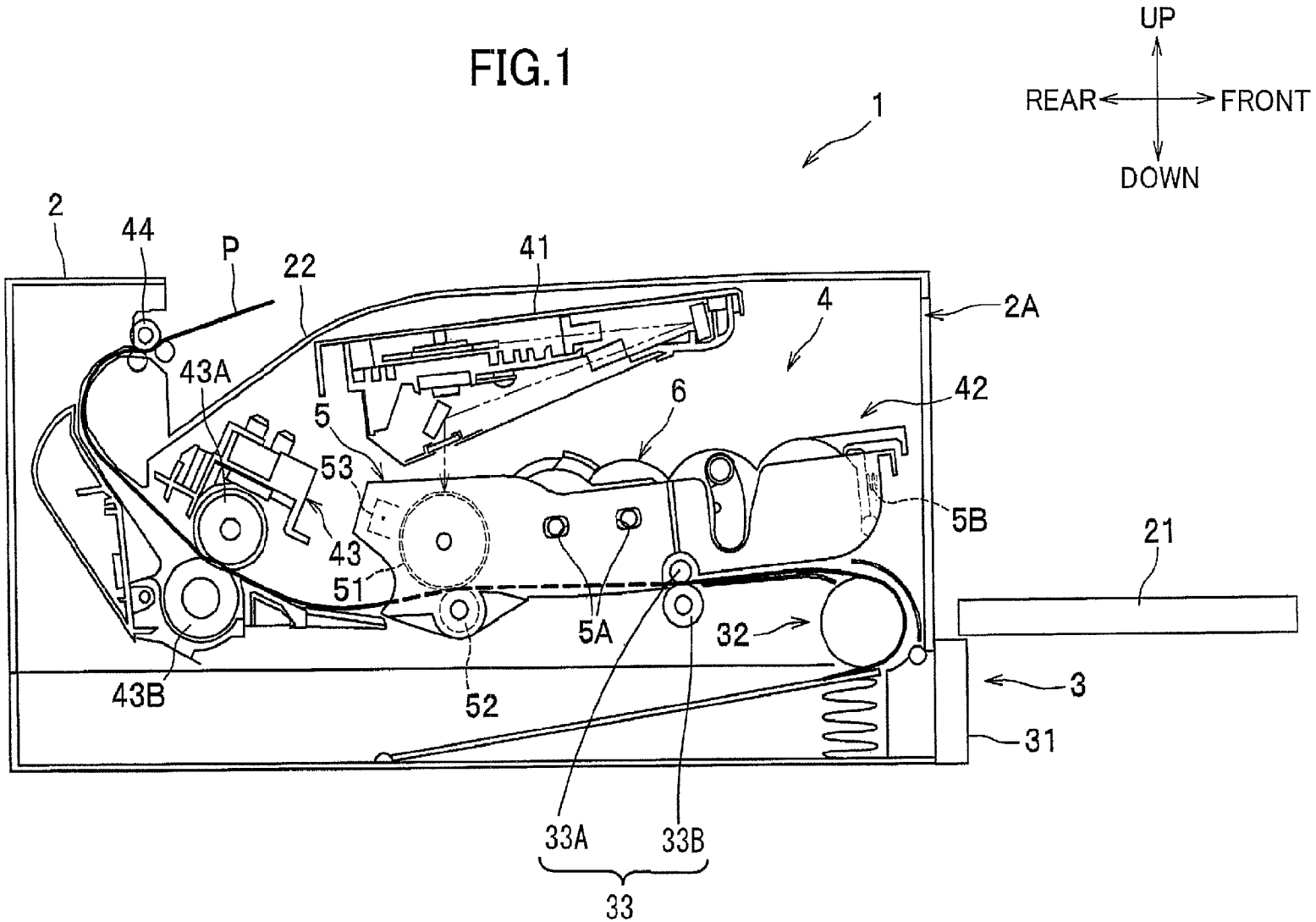
FIG. 1 is a schematic cross-sectional view of a laser printer provided with a developing unit according to a first embodiment of the present invention.

As shown in FIG. 1, the laser printer 1 includes a main frame 2, a feeder unit 3, and an image forming unit 4. The main frame 2 has a generally box shaped configuration and has a front wall formed with a front opening 2A and provided with a front cover 21 pivotally movable frontward and rearward for opening and closing the front opening 2A. The main frame 2 has a top surface functioning as a discharge tray 22 onto which a sheet P bearing an output image is discharged.

The feeder unit 3 includes a sheet cassette 31 and a sheet supplying mechanism 32 for supplying each sheet on the sheet cassette 31 to the image forming unit 4. A pair of registration rollers 33 (33A, 33B) is provided downstream of the sheet supplying mechanism 32 for correcting orientation of the sheet P and for regulating sheet feeding timing.

The image forming unit 4 includes a scanner unit 41, a process cartridge 42 having a photosensitive drum, and a fixing device 43. The scanner unit 41 includes a laser emitting portion, a polygon mirror, lenses and a reflection mirror. In the scanner unit 41, the laser beam runs along a passage as indicated by two dotted chain line and is irradiated at high speed onto a surface of the photosensitive drum 51.

The process cartridge 42 is detachable from the main frame 2 through the front opening 2A after the front cover 21 is opened. The process cartridge 42 includes a drum cartridge 5 and a developing unit 6 pivotally movably supported to the drum cartridge 5. The drum cartridge 5 includes the photosensitive drum 51, a transfer roller 52 and a scorotron charger 53. The drum cartridge 5 has side plates formed with slots 5A extending in frontward/rearward direction.

Figure 2:
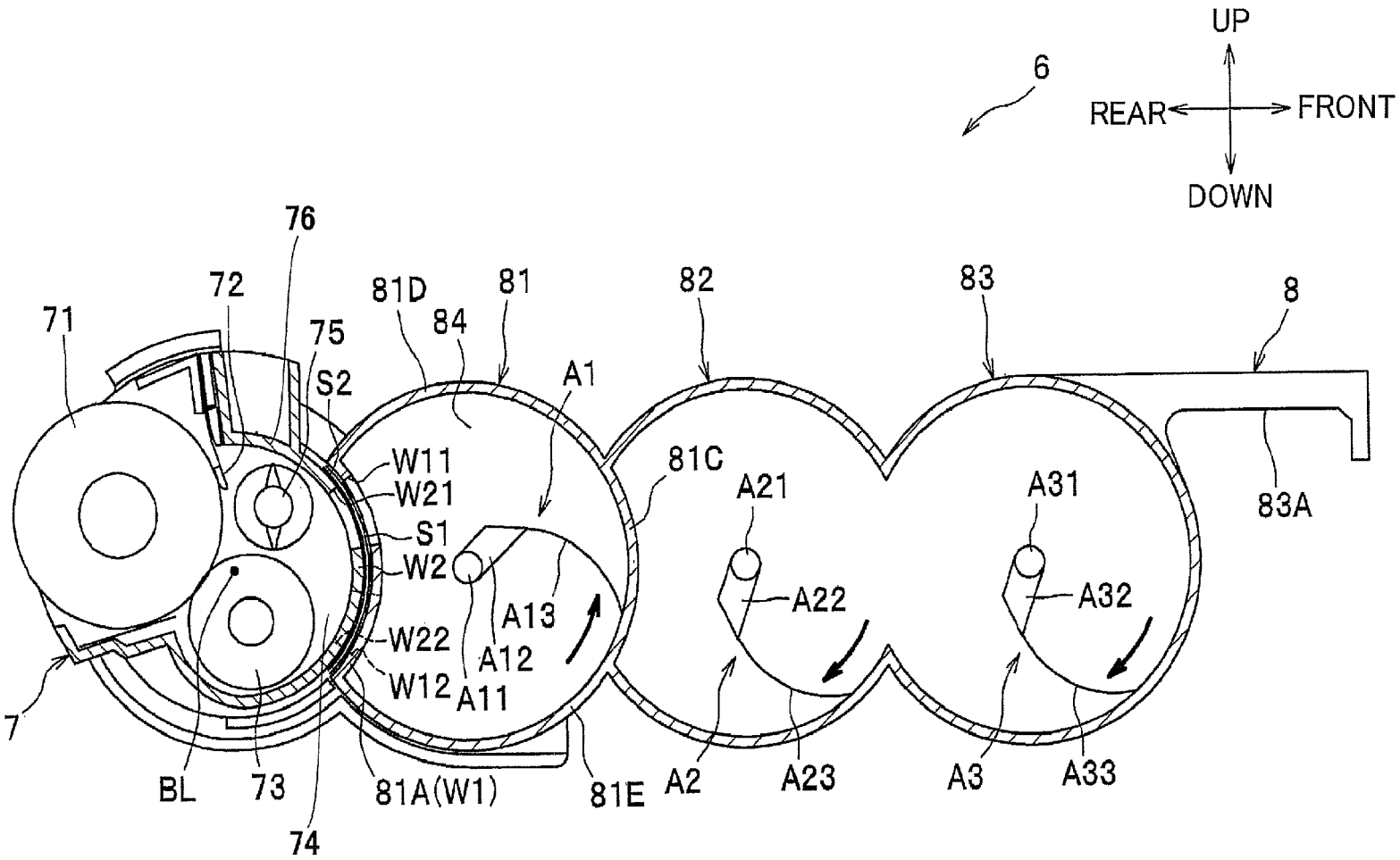
FIG. 2 is a cross-sectional view of the developing unit according to the first embodiment.

As shown in FIG. 2, the developing unit 6 includes a developing device 7 and a developer cartridge 8 detachably attached to the developing device 7. The developing unit 6 is assembled to the drum cartridge 5 through the slots 5A and is movable frontward/rearward within a length of the slots 5A. A biasing member such as a spring 5B is provided to urge the developer cartridge 8 rearward, whereupon the developing device 7 is pressed against the photosensitive drum 51.

The developing device 7 includes a developing roller 71, a blade 72, and a toner supply roller 73. The developer cartridge 8 is adapted to accommodate therein a developing agent (toner) and to supply toner to the developing device 7. Detailed structure of the developing device 7 and the developer cartridge 8 will be described later.

The toner supplied to the developing device 7 from the developer cartridge 8 is supplied to the developing roller 71 by the toner supply roller 73. In this instance, the toner is charged with a positive polarity between the rollers 71 and 73. The toner carried on the developing roller 71 is then scraped by the blade 72 in accordance with the rotation of the developing roller 71, so that a toner layer having a uniform thin thickness can be formed on the surface of the developing roller 71.

On the other hand, in the drum cartridge 5 shown in FIG. 1, the outer peripheral surface of the photosensitive drum 51 is uniformly changed with a positive polarity by the charger 53, and then the outer surface is exposed to laser beam at high speed by the scanner unit 41. Thus, a potential of the exposed region will be lowered to form an electrostatic latent image based on image data. Then, toner carried on the developing roller 71 will be supplied to the latent image region in accordance with the rotation of the developing roller 71, since the toner layer is in contact with the outer peripheral surface of the photosensitive drum 51.

Accordingly, a visible toner image corresponding to the electrostatic latent image is formed on the surface of the photosensitive drum 51. Then, the toner image will be transferred onto the sheet P when the sheet P passes between the photosensitive drum 51 and the transfer roller 52.

The fixing device 43 includes a heat roller 43A and a pressure roller 43B. The toner image carried on the sheet P can be thermally fixed to the sheet P when the sheet is thermally pressed between the rollers 43A and 43B. A discharge roller 44 is provided downstream of the fixing unit 43 for discharging the sheet P onto the discharge tray 22.

(Structure of Developing Unit) Next, the developer cartridge 8 and the developing device 7 those constituting the developing unit 6 will be described.

(Structure of Developer Cartridge)

As shown in FIG. 2, the developer cartridge 8 includes first through third toner accommodating portions 81, 82, 83 and a grip portion 83A protruding frontward from the third toner accommodating portion 83. The developer cartridge 8 has side walls 84 (FIG. 3) defining the first through third toner accommodating portions 81, 82, 83. The first toner accommodating portion 81 is positioned horizontally beside the developing device 7 upon installation of the developing unit 6 into the main frame 2, and has a hollow cylindrical shape. The first toner accommodating portion 81 has a first arcuate wall part 81A (first wall part W1) neighboring the developing device 7. The first wall part 81A (W1) is arcuately recessed toward an interior of the first toner accommodating portion 81.

Figure 5:
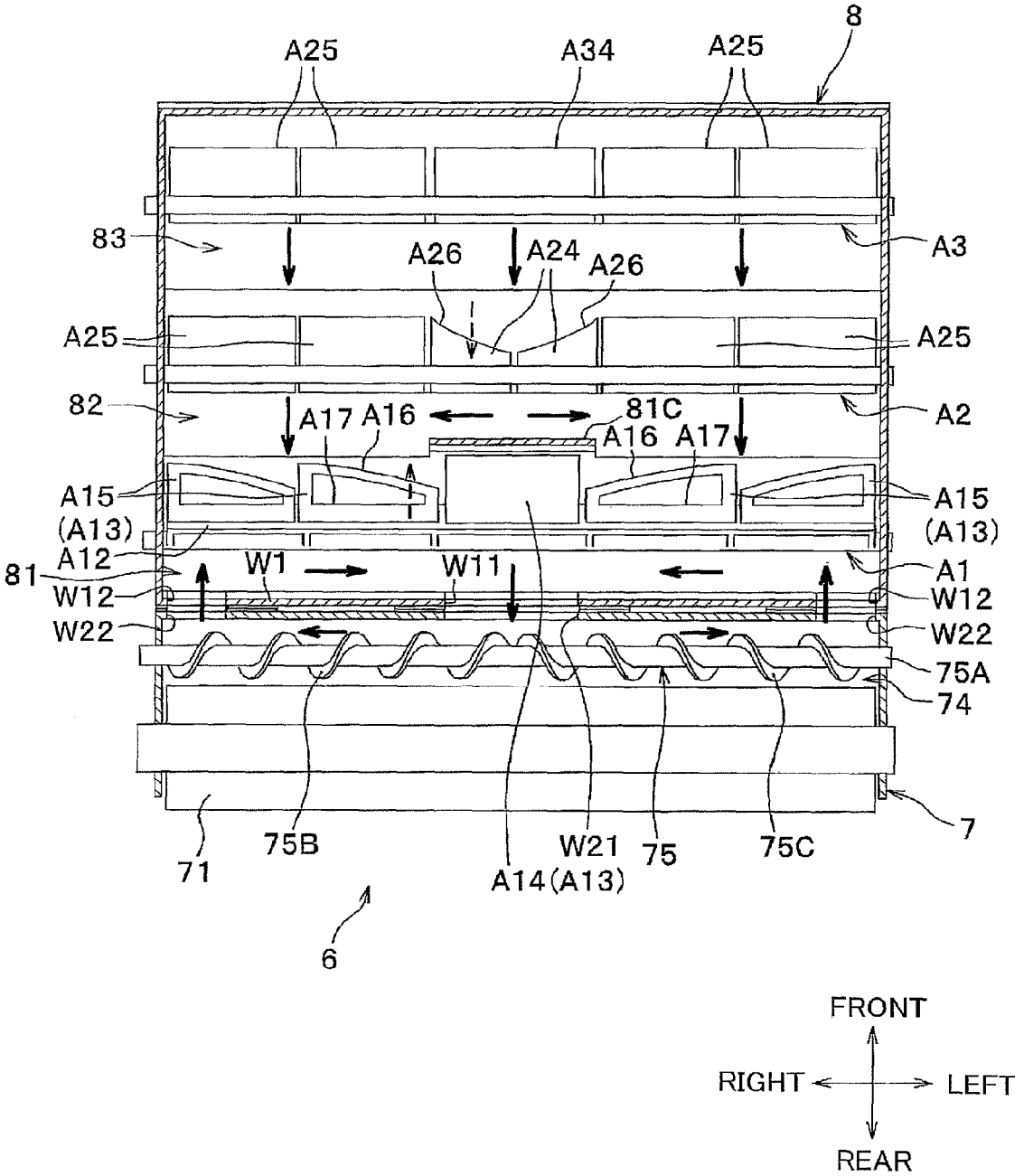
FIG. 5 is a view for description of each compartment in the developing unit according to the first embodiment.

The first toner accommodating portion 81 has a second arcuate wall part 81C opposite to the first arcuate wall part 81A, an upper arcuate wall part 81D and a lower arcuate wall part 81E. The first and second toner accommodating portions 81 and 82 are communicated with each other as shown in FIG. 5, but the second arcuate wall part 81C partially blocks the communication at a lateral center portion of the first and second toner accommodating portions 81, 82.

Figure 8:
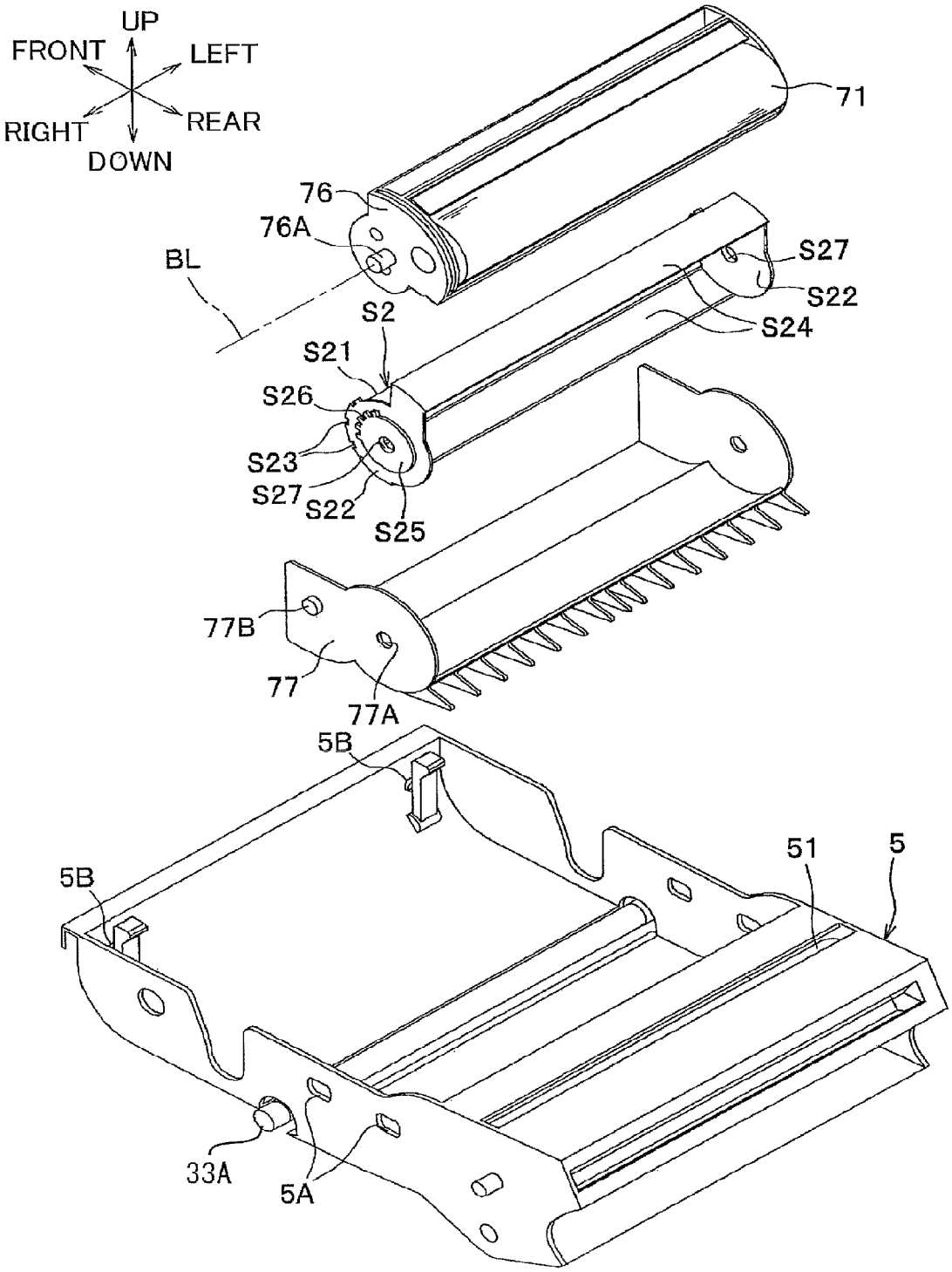
FIG. 8 is an exploded perspective view of the developing device and a drum cartridge according to the first embodiment.
Figure 9A:
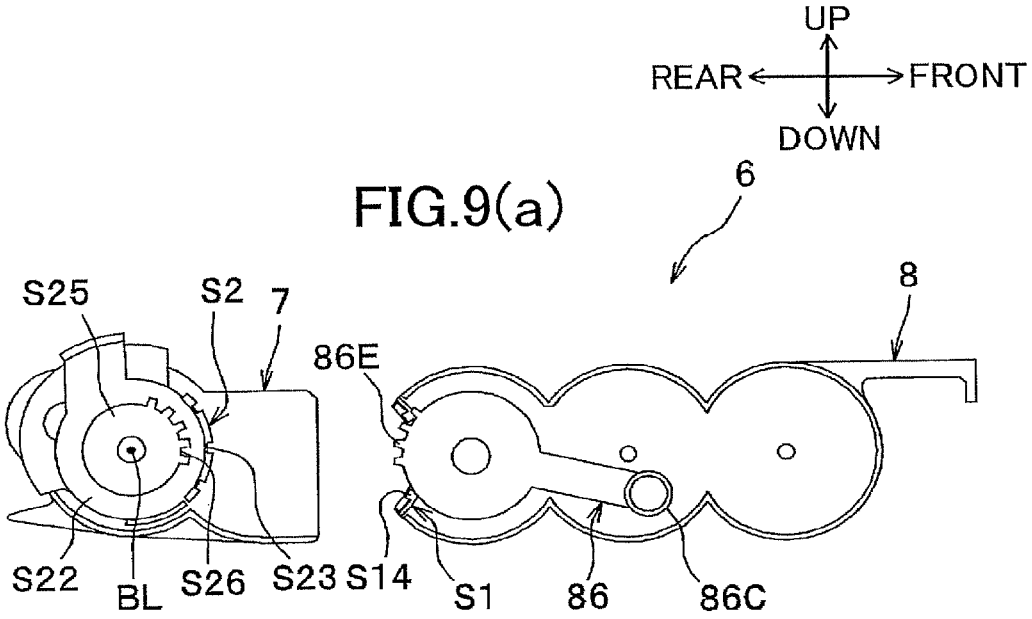
FIG. 9(*a*) is a view for description of closed state of shutters in a developing unit according to the first embodiment.
Figure 9B:
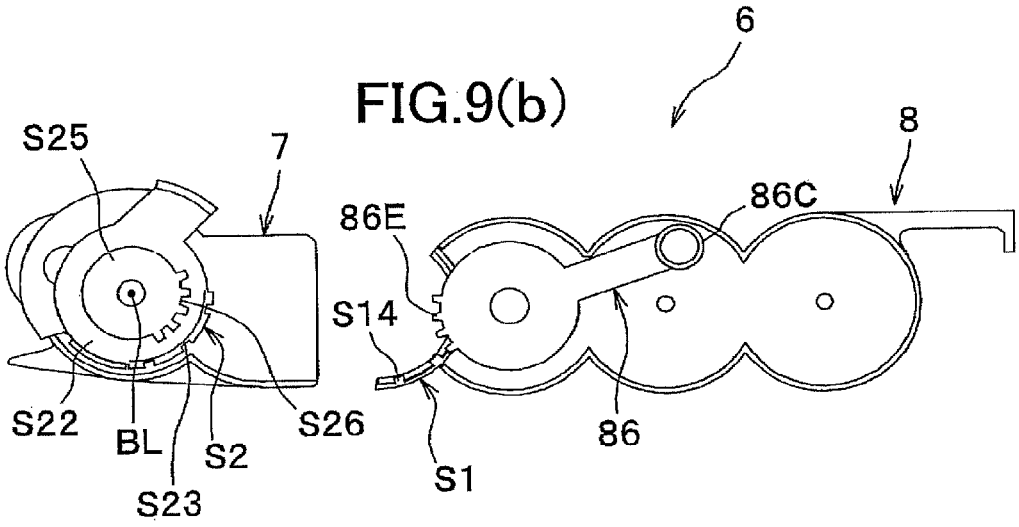

More specifically, as shown in FIGS. 8 and 9, the first arcuate wall part 81A has an imaginary center of radius of a curvature, the imaginary center being coincident with a reference line BL positioned rearward of the first toner accommodating portion 81 and extending in a lateral direction (rightward/leftward direction, i.e., in a direction parallel to a rotation axis of an agitator A1 described later. The line BL is coincident with a pivot axis of a second shutter S2 described later. With the arcuate shape, the first wall part W1 is provided by a combination of a first wall region (upper half wall region) a vertically intermediate wall region contiguous with the first wall region, and a second wall region (lower half wall region) contiguous with the intermediate wall region. The first wall region is sloped downward toward an interior of the first toner accommodating portion 81, and the second wall region is sloped upward substantially symmetrically with the first wall region.

Figure 3:
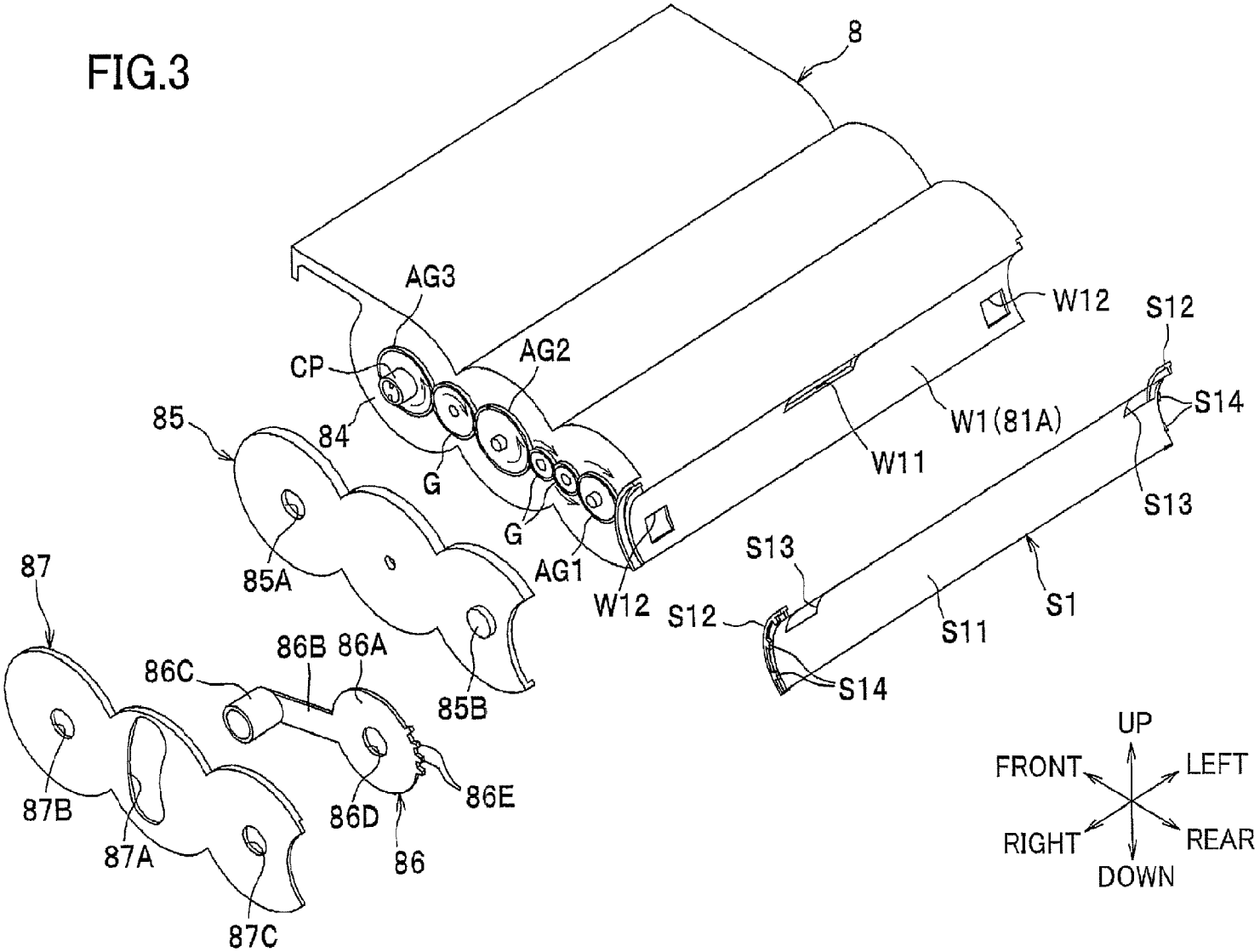
FIG. 3 is an exploded perspective view of a developer cartridge according to the first embodiment as viewed from diagonally rightward and above.

As shown in FIG. 3, the first arcuate wall part W1 is formed with a first through-hole W11 at the first wall region and a pair of second through-holes W12 at the second wall region those allowing fluid communication between inside and outside of the first toner accommodating portion 81. The first through-hole W11 is solely formed at the upper half and laterally center portion of the first arcuate wall portion W1. In other words, the first through-hole W11 is open from the first toner accommodating portion 81 to the developing device 7 diagonally downward. The pair of second through-holes W12 are formed at the lower half and laterally end portions of the first arcuate wall portion W1. That is, the second through-holes W12 are positioned offset from the first through-hole W11 in both vertical and lateral directions. Thus, the second pair of through-holes W12 are open to the developing device 7 diagonally upward.

Figure 4A:
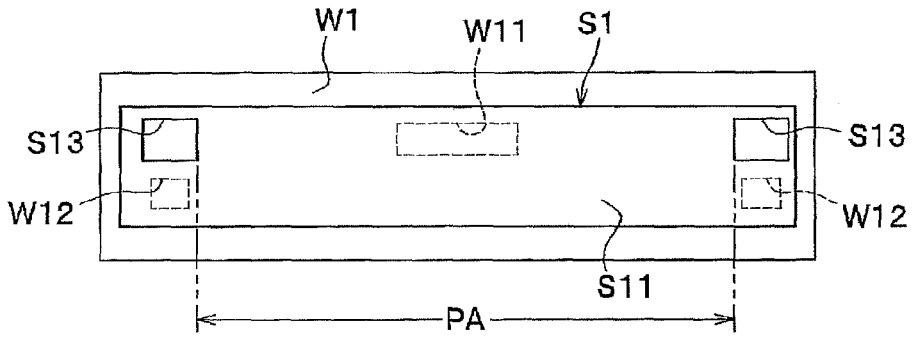
FIG. 4(*a*) is a view for description of closure of through-holes in the developer cartridge according to the first embodiment.
Figure 4B:
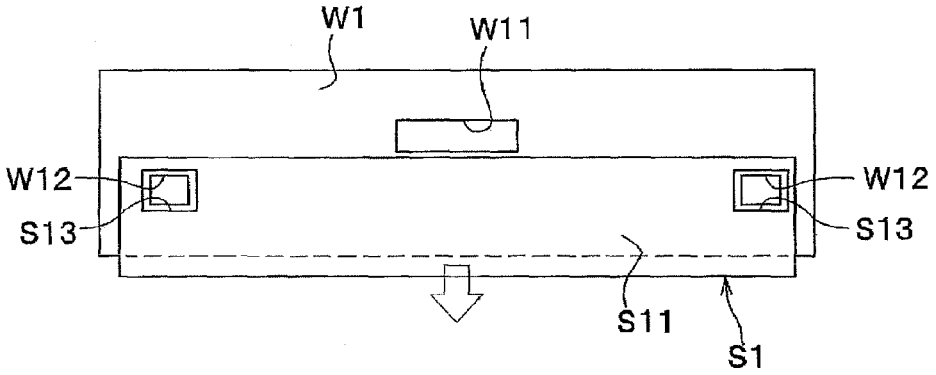

Further, as shown in FIG. 4(*a*), the second pair of through-holes W12 are positioned outside of a printable area PA which is indicative of a maximum width (maximum length in a direction perpendicular to the sheet conveying direction, i.e., the lateral direction) of the toner image transferred onto the sheet P. Because of the formation of the second pair of through-holes W12 at positions outside of the printable area PA, toner accumulation in the developing device 7 at the lateral end portions thereof can be restrained. In the developing device 7, toner amount at positions in direct confrontation with the second through-holes W12 may be lowered. However, this toner shortage does not cause any problem since no image formation is required at positions outside of the printable area. Further, each second through hole W12 is provided by a combination of a plurality of through-holes.

As shown in FIG. 3, a first shutter S1 is provided immediately behind the first arcuate wall part W1. The first shutter S1 is movable in a circumferential direction of the wall part W1 for opening and closing the first and second through-holes W11 and W12. The first shutter S1 includes a thin arcuate metal plate S11 having a shape in conformance with that of the first arcuate wall part W1, and a pair of slide segments S12 each provided at each lateral end of the metal plate S11.

The metal plate S11 has an upper lateral end portions each formed with a through-hole S13 having a size greater than that of the second through-hole W12. On the other hand, no through-holes are formed in a lower portion of the metal plate S11. Thus, as shown in FIG. 4(*a*), in case the first shutter S1 is at a closed position, an upper laterally intermediate portion of the metal plate S11 (a portion between the through holes S13 and S13) closes the first through-hole W11, and a lower portion of the metal plate S11 (each portion lower than the through-hole S13) closes the pair of second through-holes W12.

On the other hand, as shown in FIG. 4(*b*), in case the first shutter S1 has been moved to an open position lower than the closed position, an upper edge of the metal plate S11 has moved past downward the first through-hole W11 to open the same, and each through-hole S13 is aligned with each second through-hole W12 to open the same.

As shown in FIG. 3, each slide segment S12 is slidably supported to the developer cartridge 8, and has a plurality of projections S14 engageable with a plurality of recesses S23 (described later) formed in each engagement plate S22 (described later) of the second shutter S2 (described later).

As shown in FIG. 2, a single first agitator A1 is disposed in the first toner accumulating portion 81. The first agitator A1 is rotatable in a counterclockwise direction in FIG. 2 so that the first agitator A1 is slidingly moved relative to the first artucate wall part W1 from its upper portion to the lower portion. The first agitator A1 includes a rotation shaft A11 rotatably supported to the side walls 84, a support section A12 provided to the rotation shaft A11 at radially outer side thereof, and a first agitation blade A13 supported to the support section A12.

As shown in FIG. 5, the first agitation blade A13 includes a laterally center blade (first blade) A14, and lateral end blades (second blades) A15 including two right end blades A15, and two left end blades A15. The agitation blade A13 has a lateral length capable of slidingly contacting with the first through-hole W11 and the second through-holes W12.

The center blade A14 has a rectangular shape and is made from a flexible and resilient material having a lateral width substantially the same as that of the first through-hole W11. The center blade A14 is slidable with respect to the second arcuate wall part 81C, the upper wall part 81D, the first arcuate wall part 81A (the first through-hole W11), and the lower wall part 81E.

As shown in FIG. 5, an opening for communication between the first and second toner accommodating portions 81 and 82 is partially blocked by the second arcuate wall part 81C positioned at the lateral center portion of the opening. More specifically, the second arcuate wall part 81C is aligned with the first through-hole W11 in vertical direction and frontward/rearward direction and has a lateral length not less than that of the center blade A14. Thus, toner carried on the center blade A14 can be efficiently conveyed along the surfaces of the second arcuate wall part 81C and the upper wall part 81D toward the first through-hole W11.

Each end blade A15 is made from a flexible and resilient material, and has a radial free edge A16 slanted toward the center blade A14 such that a radial length from a base edge to the free edge A16 is gradually smaller toward the center blade A14. In other words, the free edge A16 is slanted toward an upstream side in the rotating direction of the agitation blade A13 as indicated by a broken arrow from a laterally outer edge to the laterally inner edge of the end blade A15. In summary, each end blade should have a shape and/or orientation of the base edge (supported to the support section A12) capable of providing a difference in contacting timing such that the laterally outer portion of the free edge A16 is brought into contact with the inner surface of the first toner accommodating portion 81 at a timing faster than the contact timing of the laterally inner portion of the free edge A16 with the inner surface.

Because of the belated sliding contact of the laterally inner portion of the free edge A16 in comparison with the laterally outer portion thereof, the toner can be conveyed from the laterally outer portion to the laterally center portion (from the second pair of through-holes W12 to the first through-hole W11). Further, each end blade A15 has a center region formed with a bore A17 through which toner can be leaked. That is, the toner directing from the developing device 7 through second through-hole W12 to the first toner accommodating portion 81 can be maintained within the first toner accommodating portion 81 avoiding excessive toner circulation into the second toner accommodating portion 82.

As shown in FIG. 2, the second toner accommodating portion 82 is positioned horizontally beside the first toner accommodating portion 81 upon assembly of the developing unit 6 into the main frame 2. The second toner accommodating portion 82 has generally hollow cylindrical shape and has a rear portion in fluid communication with the first toner accommodating portion 81 except the second arcuate wall part 81C and has a front portion in communication with the third toner accommodating portion 83.

A second agitator A2 is disposed in the second toner accommodating portion 82 and is rotatable in a direction opposite to the rotating direction of the first agitator A1 for conveying the toner in the second toner accommodating portion 82 to the first toner accommodating portion 81. The second agitator A2 includes a rotation shaft A21, and a support section A22 those being the same as the rotation shaft A11 and the support section A11, and an agitation blade A23 different from the agitation blade A13.

As shown in FIG. 5, the agitation blade A23 includes a pair of center blades (third blades) A24 flexible and resiliently deformable, and lateral end blades (fourth blades) A25 having a rectangular shape and including two right end blades A25 and two left end blades A25 those being flexible and resiliently deformable.

The third blades A24 are arrayed side by side and have a combined lateral length corresponding to the lateral length of the second arcuate wall part 81C. The third blades A24 have free edges A26 in sliding contact with an inner surface of the second toner accommodating portion 82. Each free edge A26 is slanted toward a lateral center such that a radial length from a base edge to the free edge A26 is gradually decreased toward the lateral center. In other words, the free edge A26 is slanted toward an downstream side in the rotating direction of the agitation blade A23 as indicated by a broken arrow from a laterally outer edge to the laterally inner edge of each third blade A24. In summary, each third blade A24 should have a shape and/or orientation of the base edge (supported to the support section A22) capable of providing a difference in contacting timing such that the laterally inner portion of the free edge A26 is brought into contact with the inner surface of the second toner accommodating portion 82 at a timing faster than the contact timing of the laterally outer portion of the free edge A26 with the inner surface.

Because of the belated sliding contact of the laterally outer portion of the free edge A26 in comparison with the laterally inner portion thereof, the toner can be conveyed from the laterally center portion to the laterally outer portion. That is, each third blade A24 is adapted to convey toner from the laterally center portion to the laterally outer portion of the second toner accommodating portion 82. Thus, the toner conveyed by the third blades A24 is urged toward each fourth blade A25 along the second arcuate wall part 81C, and is then delivered into the first toner accumulating portion 81 by the fourth blades A25.

As shown in FIG. 2, the third toner accommodating portion 83 is positioned horizontally beside the second toner accommodating portion 82 upon assembly of the developing unit 6 into the main frame 2. The third toner accommodating portion 83 has generally hollow cylindrical shape and has a rear portion in its entirety in fluid communication with the second toner accommodating portion 82.

A third agitator A3 is disposed in the third toner accommodating portion 83 and is rotatable in a direction opposite to the rotating direction of the first agitator A1 for conveying the toner in the third toner accommodating portion 83 to the second toner accommodating portion 82. The third agitator A3 includes a rotation shaft A31, a support section A32 being the same as the rotation shaft A21 and the support section A21, and an agitation blade A33 different from the agitation blade A23.

As shown in FIG. 5, the agitation blade A33 includes a laterally center blade (fifth blade) A34 and lateral end blades A25 including two right blades A25 and two left blade A25. The fifth blade A34 has a rectangular shape and is flexible and resiliently deformable. The lateral end blades A25 are identical to the fourth blades A25 of the second agitator A2.

As shown in FIG. 3, first through third agitator gears AG1, AG2, AG3 are concentrically and fixedly mounted on right end portions of the rotation shaft A11, A21, A31, respectively. Two intermediate gears G,G are meshingly interposed between the first and second agitator gears AG1 and AG2, and a single gear G is meshingly interposed between the second and third agitator gears AG2 and AG3. A coupling CP is provided at an axial center portion of the third agitator gear AG3 for receiving a driving force output from a drive source (not shown).

Upon output of drive force from the drive source to the coupling CP, the third and second agitator gears AG3, AG2 are rotated in the same direction (counterclockwise direction in FIG. 3), whereas the first agitator gear AG1 is rotated in the opposite direction (clockwise direction in FIG. 3). A gear case 85 is detachably provided to the side wall 84 of the developer cartridge 8 for covering these agitator gears AG1, AG2, AG3.

The gear case 85 is formed with a bore 85A allowing the coupling CP to pass therethrough, and has a shaft portion 85B protruding outward in lateral direction. A manipulation member 86 is pivotally movably supported to the shaft portion 85B. The manipulation member 86 is adapted to interlockingly move the first shutter S1 and the second shutter S2 described later in association with FIG. 9 for opening and closing motion of these shutters. The manipulation member 86 includes a base portion 86A, an arm portion 86B, and a manipulation portion 86C. The base portion 86A is of a disk shape formed with a center hole 86D through which the shaft portion 85B extends. The base portion 86A is rotatable about an axis of the shaft portion 85B. The base portion 86A has a rear portion provided with teeth 86E. The arm portion 86B extends radially outward (frontward) from the base portion 86A, and has a free end provided with the manipulation portion 86C protruding laterally outward.

Figure 7:
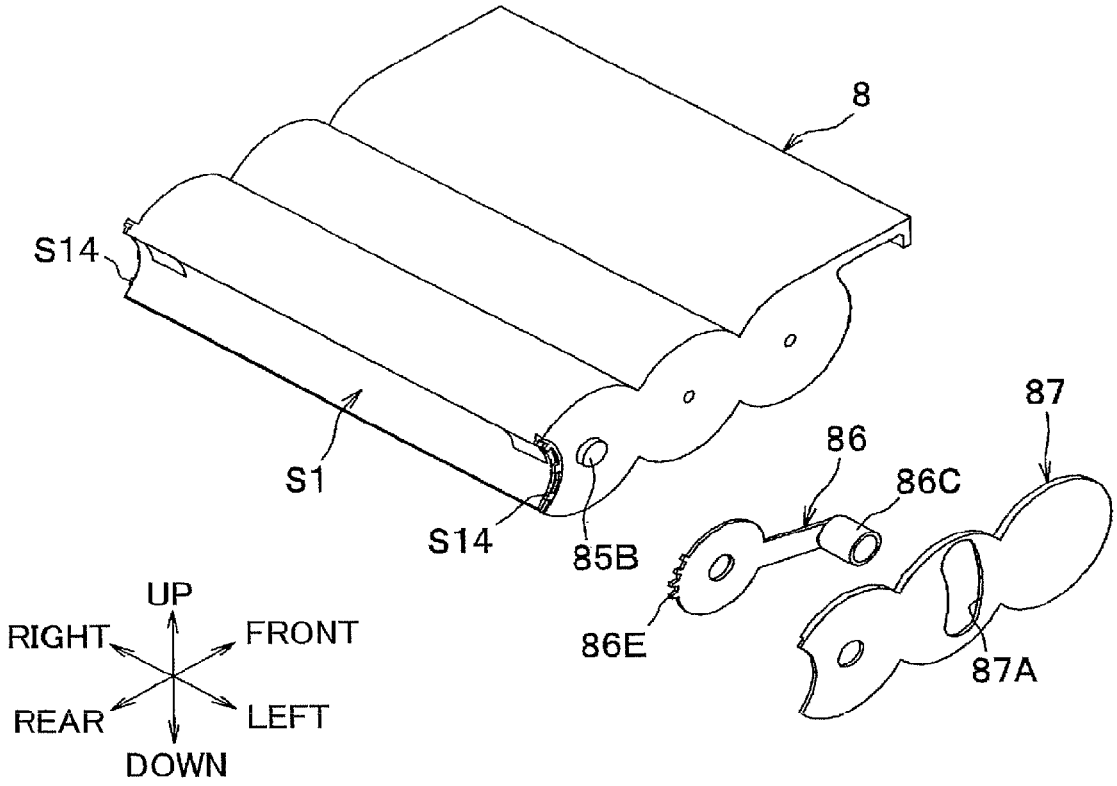
FIG. 7 is an exploded perspective view of the developer cartridge according to the first embodiment as viewed from a diagonally left upward.

A cover member 87 is provided for covering the gear case 85 and positioned outward of the manipulation member 86. The cover member 87 is formed with an elongated arcuate slot 87A through which the manipulation portion 86C extends to be accessible by a user. The cover member 87 is also formed with a first bore 87B allowing the coupling CP to pass therethrough and a second bore 87C allowing the shaft portion 85B to pass therethrough. As shown in FIG. 7, the shaft portion 85B, the manipulation member 86 and the cover member 87 are also provided at the left side of the developer cartridge 8.

(Developing device) As shown in FIG. 2, the developing device 2 has a developing case 76 defining therein a developing chamber 74 in which the developing roller 71 and the toner supply roller 73 are disposed. Further, an auger 75 functioning as a toner feeder is disposed in the developing chamber and above the toner supply roller 73.

The developing case 76 has an arcuate case wall part W2 at a front side thereof. The arcuate case wall part W2 is positioned in direct confrontation with the first arcuate wall part W1 of the first toner accommodating portion 81, and has a shape in conformance with that of the first arcuate wall part W1. The arcuate case wall part W2 has an upper lateral center portion where a third through-hole W21 corresponding to the first through-hole W11 of the first arcuate wall part W1 is formed. The arcuate case wall part W2 has a lower lateral end portions where fourth through-holes W22 corresponding to the second through-holes W12 of the first arcuate wall part W1 are formed.

In other words, the third through-hole W21 is positioned above the fourth through-holes W22 and is open from the developer cartridge 8 to the developing device 7 diagonally downward. The pair of fourth through-holes W22 are open to the developing device 7 from the developer cartridge 8 diagonally upward.

The second shutter S2 is provided immediately frontward of the arcuate case wall part W2. The second shutter S2 is movable in a circumferential direction of the wall part W2 for opening and closing the third and fourth through-holes W21 and W22. As shown in FIGS. 8, 9(*a*) and 9(*b*), the second shutter S2 includes a thin arcuate metal plate S21 and a pair of engagement plates S22 each provided at each lateral end of the metal plate S21.

The arcuate metal plate S21 has a shape in conformance with that of the metal plate S11 of the first shutter S1. The metal plate S21 is movable in a manner the same as that of the metal plate S11 as shown in FIGS. 4(*a*) and 4(*b*) for opening and closing the third and fourth through-holes W21, W22.

The engagement plate S22 is of a disk shape and has a rear portion formed with a plurality of recesses S23 engaged with the plurality of projections S14 of the first shutter S1. Two beam plates S24 extends in the lateral direction for connecting the pair of engagement plates S22 to each other. as shown in FIG. 8 so as to improve rigidity of the second shutter S2.

A second engagement plate S25 is provided concentrically with each first engagement plate S22 at laterally outer side. The second engagement plate S25 has a rear portion formed with a plurality of recesses S26 engaged with the teeth 86E of the manipulation member 86.

The developing case 76 has a pivot shaft 76A extends laterally outward. The first and second engagement plates S22 and S25 have center regions formed with bores S27 through which the pivot shaft 76A rotatably extends. Thus the second shutter S2 is pivotally movable relative to the developing case 76.

A support case 77 is supported to the drum cartridge 5. The support case 77 is formed with a support hole 77A and has a cylindrical projection 77B. The pivot shaft 76A extends through the support hole 77A. The pivot shaft 76A and the cylindrical projection 77B are engaged with the respective slots 5A (FIG. 1) of the drum cartridge 5, so that the developing device 7 is movable in frontward/rearward direction within a stroke of the slots 5A.

As shown in FIGS. 9(*a*) and 9(*b*), the second shutter S2 is movable between a closed position and an opening position along with the first shutter S1 upon pivotal movement of the manipulation member 86. Incidentally, for better understanding to the closing and opening motion of the shutters, the developing device 7 and the developer cartridge 8 are shown separately from each other.

More specifically, when the manipulation portion 86C of the member 86 is moved upward, the teeth 86E of the manipulation member 86 push the plurality of recesses S26 of the second engagement plate S25 downward. Thus, the second shutter S2 initially at the closing position as shown in FIG. 9(*a*) is pivotally moved in a clockwise direction in FIG. 9(*b*). By the pivotal movement of the second shutter S2, the plurality of recesses S23 of the engagement plate S22 push the plurality of projections S14 of the first shutter S1 in the clockwise direction. Thus, the first shutter S1 can also be pivotally moved in the clockwise direction along with the second shutter S2.

Thus, the first and second through-holes W11, W12, W21, W22 are opened as shown in FIG. 4(*b*). For closing these through-holes, the manipulation portion 86C be moved downward so as to pivotally move the first and second shutters S1, S2 in the counterclockwise direction as shown in FIG. 4(*a*).

Figure 6:
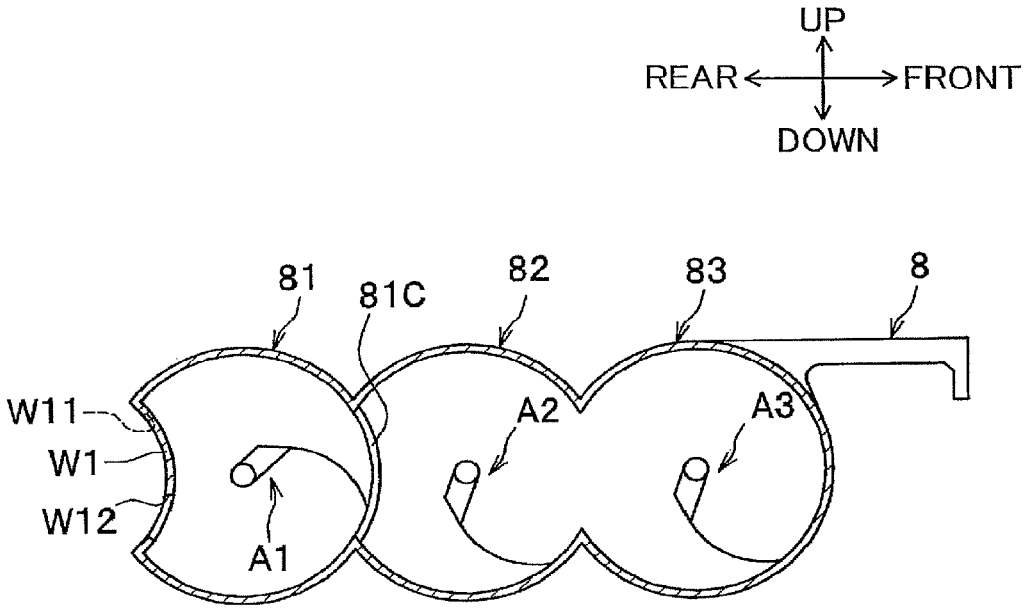
FIG. 6 is a cross-sectional view of the developer cartridge taken along a second opening according to the first embodiment.

As shown in FIG. 6, the auger 75 is adapted to feed toners delivered through the third through-hole W21 toward laterally outward (toward the fourth through hole W22). To this effect, the auger 75 includes a rotation shaft 75A, a first spiral feeder 75B and a second spiral feeder 75C disposed over the rotation shaft 75A.

The first and second spiral feeders 75B and 75C extends over a laterally right region, and the laterally left region, respectively with respect to the third through-hole W21, and spiral direction of the feeders are different from each other. Thus, toner can be fed to the laterally right region and left region by the first spiral feeder 75B and the second spiral feeder 75C, respectively.

(Behavior of the toner) As shown in FIG. 2, toner in the first toner accommodating portion 81 is lifted upward by the agitation blade A13 of the first agitator A1 when the agitation blade A13 is in sliding contact with the second arcuate wall part 81C. Thereafter, the toner carried on the agitation blade A13 is moved along the upper wall part 81D, and then conveyed to the first through-hole W11.

Since the first through-hole W11 is open diagonally downward from the first toner accommodating portion 81 to the developing device 7, no positive pushing force is required in the first agitator A1 so as to forcibly direct the toner into the first through-hole W11, but a surface contact of the first agitator A1 with the first through-hole W11 is only required. In the latter case, the toner can be naturally flowed into the developing chamber 74 through the first through-hole W11 because of own weight of the toner when the agitation blade A13 reaches the upper portion of the first through-hole W11.

The toner is then moved past the first through-hole W11 and the third through-hole W21 diagonally downward because of own weight of the toner, and conveyed into the developing device 7. Then, the toner is fed rightward and leftward by the auger 75.

Accordingly, the toner can be distributed over an entire lateral length of the developing chamber 74, thereby efficiently supplying toner from the toner supply roller 73 to the developing roller 71. Further, when the toner is fed to the fourth through-holes W22 by the auger 75, the toner is naturally flowed into the first toner accommodating portion 81 through the fourth through-holes W22 and the second through-holes W12 because of own weight of the toner, since these holes are open diagonally downward toward the first toner accommodating portion 81. Thus, toner supply from the first toner accommodating portion 81 to the developing device 7 can be efficiently performed by the first through-hole W11, and the return of the toner from the developing device 7 to the first toner accommodating portion 81 can be efficiently performed by the second through-holes W12.

The toner returned back to the first toner accumulating portion 81 is urged toward laterally center portion thereof by the end blades A12, and then, the toner is again conveyed to the first through-hole W11 by the center blade A14.

On the other hand, toner in the second toner accommodating portion 82 is urged toward laterally end portions thereof by the third blades A24, and then, conveyed into the first toner accommodating portion 81 by the fourth blades A25. Further, toner in the third toner accommodating portion 83 is conveyed into the second toner accommodating portion 82 by the third agitator A3.

According to the above-described embodiment, since the first through-hole W11 is open diagonally downward toward the developing device 7, and the second through-holes W12 are open diagonally upward toward the developing device 7, toner supply and toner return can be performed making use of own weight of the toner. Thus, toner circulation can be improved between the developing device and the developer cartridge 8.

Further, since the first through-hole W11 is positioned upward of the second through-holes W12, a back-flow of the toner from the developing device 7 to the first toner accommodating portion 81 through the first through-hole W11 can be restrained, and a back-flow of the toner from the developing device 7 to the first toner accommodating portion 81 can be efficiently performed through the second through-holes W12 disposed at position lower than that of the first through-hole W11.

Further, since the first arcuate wall part 81A (W1) is recessed toward an interior of the first toner accommodating portion 81, mere formations of the through-holes at upper half portion and lower half portion of the arcuate wall part W1 can easily direct the opening direction of the through-holes W11, W12. Thus, toner circulation can be attained with a simple construction.

Since the first agitator A1 slidingly moves along the first arcuate wall part W1 from upward to the downward and since the first through-hole W11 is open diagonally downward from the first toner accommodating portion 81 to the developing chamber 74, the toner carried on the center blade A14 can smoothly pass through the first through-hole W11 into the developing chamber 74 because of own weight of the toner. Further, since the end blades A15 of the first agitator A1 urges the toner toward the lateral center, i.e., away from the second through-holes W12, the toner returned into the first toner accommodating portion 81 from the developing chamber 74 through the second through-holes W12 is not urged back toward the developing chamber 74 through the second through-holes W12 by the movement of the first agitator A1.

Further, since the first shutter S1 is provided for opening and closing the first and second through-holes W11, W12, toner leakage can be avoided in case where the developer cartridge 8 has not yet been assembled to the developing device 7. Further, since the first shutter S1 is movable along the circumferential direction of the first arcuate wall part W1, an overall structure can be simplified in comparison with a case where a shutter is movable in an axial direction of the agitator. Particularly, in the above-described embodiment, the arcuate first shutter S1 is movable along an arcuate locus whose center of a radius of curvature is at the line BL. Therefore, stabilized opening and closing motion of the shutter can be provided without inadvertent inclination of the shutter during its movement in comparison with a case where a shutter is moved along a linear locus.

Further, since two second through-holes W12 are formed, stabilized toner return from the developing chamber 74 to the first toner accommodating portion 81 can result.

Further, since the single first through-hole W11 is formed at the lateral center portion of the first arcuate wall part W1, and each of the two second through-holes W12 is formed at each laterally end portion thereof, toner circulation can be improved in combination with the auger 75 that feeds toner to the each lateral end portion.

Further, since the second through-holes W12 are positioned outside of the printable area PA, toner deposition at a position outside of the printable area PA can be restrained, whereas sufficient amount of toner can be maintained in the printable area PA. Thus, decrease in imaging density in the printable area PA can be avoided.

Further, since the rotating direction of the second agitator A2 is opposite to that of the first agitator A1, toner deposited on a bottom of the second toner accommodating portion 82 can be pushed toward the first toner accommodating portion 81 by the second agitator A2. Thus, toner transfer from the second toner accommodating portion 82 to the first toner accommodating portion 81 can be efficiently performed. Similarly, since the third agitator A3 is rotated in a direction the same as that of the second agitator A2, toner transfer from the third toner accommodating portion 83 to the second toner accommodating portion 82 can be efficiently performed.

Further, since the second arcuate wall part 81C is provided at a position between the first and second toner accommodating portions 81 and 82 and in opposition to the first arcuate wall part 81A, the toner can be retained between the first agitator A1 and the second arcuate wall part 81C. Thus, the toner can be desirably conveyed to the first through-hole W11 positioned at the upper portion of the first arcuate wall part 81A. Further, since the second wall part 81C has arcuate shape, toner can be smoothly conveyed upward.

Further, toner circulation can be promoted, since the auger 75 is provided for feeding the toner having been conveyed through the third through-hole W21 to the fourth through-holes W22.

Since the manipulation member 86 is covered with the cover member 87 and the part of the manipulation member 86 (manipulation portion 86C) is exposed to an outside through the elongated slot 87A formed in the cover member 87, the cover can prevent foreign particle from being trapped between the manipulation member 86 and the developer cartridge 8, thereby maintaining operability on the manipulation member 86.

Since the first agitator A1 is provided with the end blades A15 for directing the toner from each second through-hole W12 to the first through-hole W11, the toner having been returned to the first toner accommodating portion 81 can again be conveyed into the developing chamber 74 through the first through-hole W11. Therefore, toner circulation performance can be improved.

A laser printer 101 according to a second embodiment of the present invention will next be described with reference to FIGS. 10 to 20(*b*). The laser printer 101 according to the second embodiment is similar to the laser printer 1 previously described, the difference being in the structure of first wall part 81A (W1) of the first toner accommodating portion 81, the case wall part W2 of the developing case 76, first and second shutters S1, S2 associated therewith and a shutter driving structure. In FIGS. 10 through 20(*b*), like parts and components are designated by the same reference numerals as those shown in FIGS. 1 through 9(*b*), and "100" series numeral designation is added to the reference numerals in FIGS. 10 through 20(*b*) which is indicative of corresponding parts and components between the first and second embodiments so that their function can be understood with reference to the description to the laser printer 1 of the first embodiment.

Figure 10:
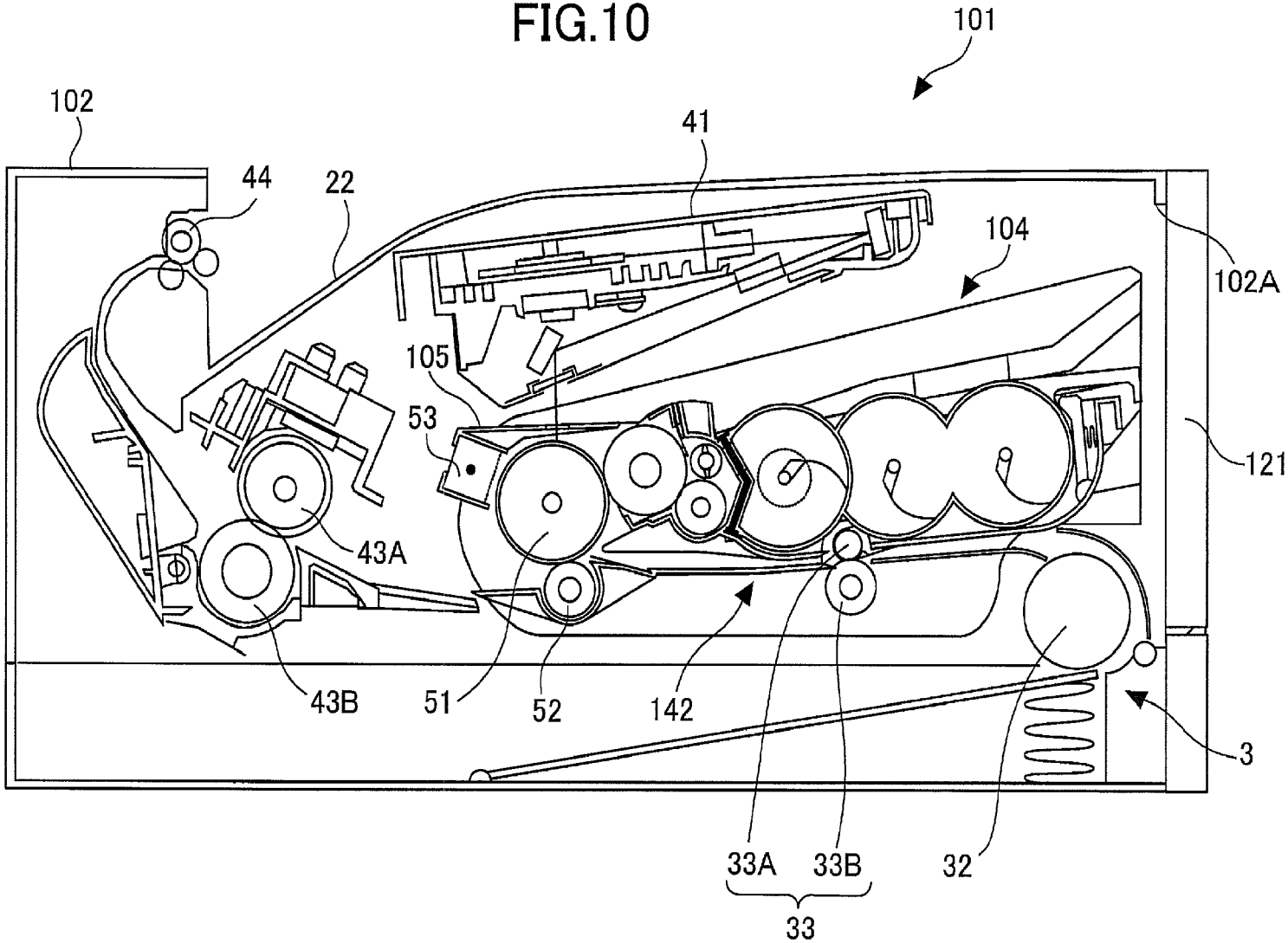
FIG. 10 is a schematic cross-sectional view of a laser printer provided with a developing unit according to a second embodiment of the present invention.
Figure 12:
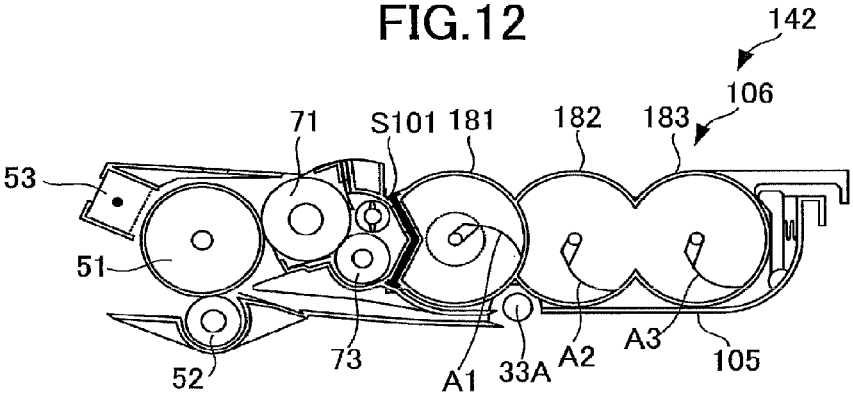
FIG. 12 is a schematic cross-sectional view of the process cartridge according to the second embodiment of the present invention.
Figure 13:
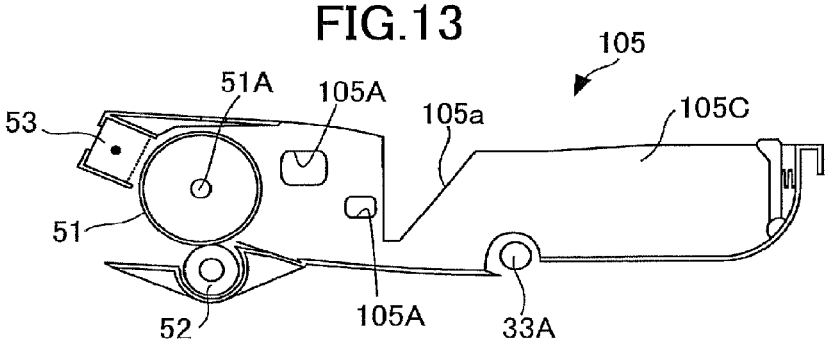
FIG. 13 is a side view of a drum cartridge prior to assembly of a developing unit according to the second embodiment of the invention.
Figure 15A:
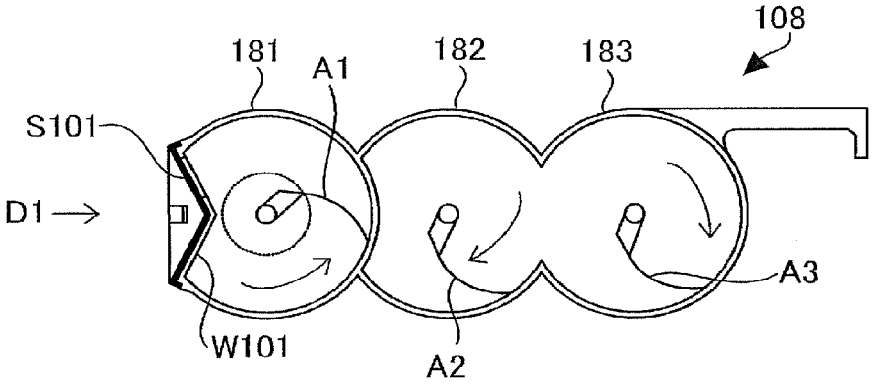
FIG. 15(*a*) is a cross-sectional view of a developer cartridge according to the second embodiment of the invention.
Figure 15B:
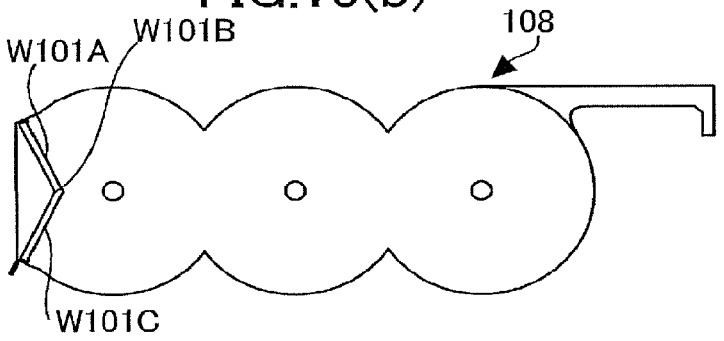
Figure 15C:
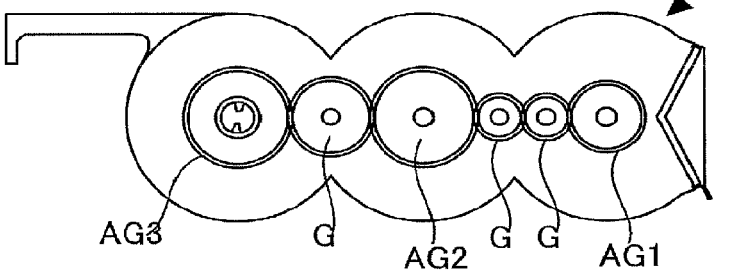

FIG. 10 shows a general structure of the laser printer 101 having an image forming unit 104. The image forming unit includes a process cartridge 142, and as shown in FIGS. 12 and 13, the process cartridge 142 includes a drum cartridge 105 and a developing unit 106 assembled to the drum cartridge 105. As shown in FIGS. 15(*a*) through 16(*b*), the developing unit 106 includes a developing device 107 and a developer cartridge 108.

Figure 11:
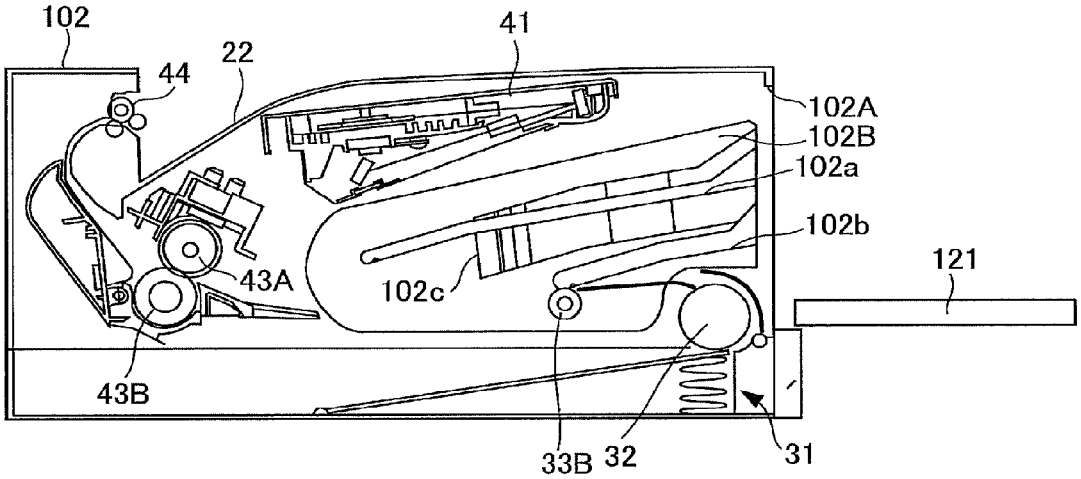
FIG. 11 is a schematic cross-sectional view of the laser printer showing a state prior to assembly of a process cartridge according to the second embodiment of the present invention.

FIG. 11 shows a state prior to loading of the process cartridge 142. Within a main frame 102, a pair of guide wall sections 102B is provided. The guide wall sections 102B include a right guide wall section 102B 1 and a left guide wall section 102B2 (see FIG. 19) spaced away from each other in the lateral direction. Each guide wall section 102B is formed with a first guide groove 102*a* and a second guide groove 102*b* extending in a direction of loading and unloading the process cartridge 142. A depth of each of the first and second guide grooves 102*a*, 102*b* in the lateral direction is uniform along its length, but a first guide groove 102*a* is longer than the second guide groove 102*b*. Each rearmost end of each guide groove 102*a*, 102*b* defines final loading position of the process cartridge 142.

Figures 19A, 19B:
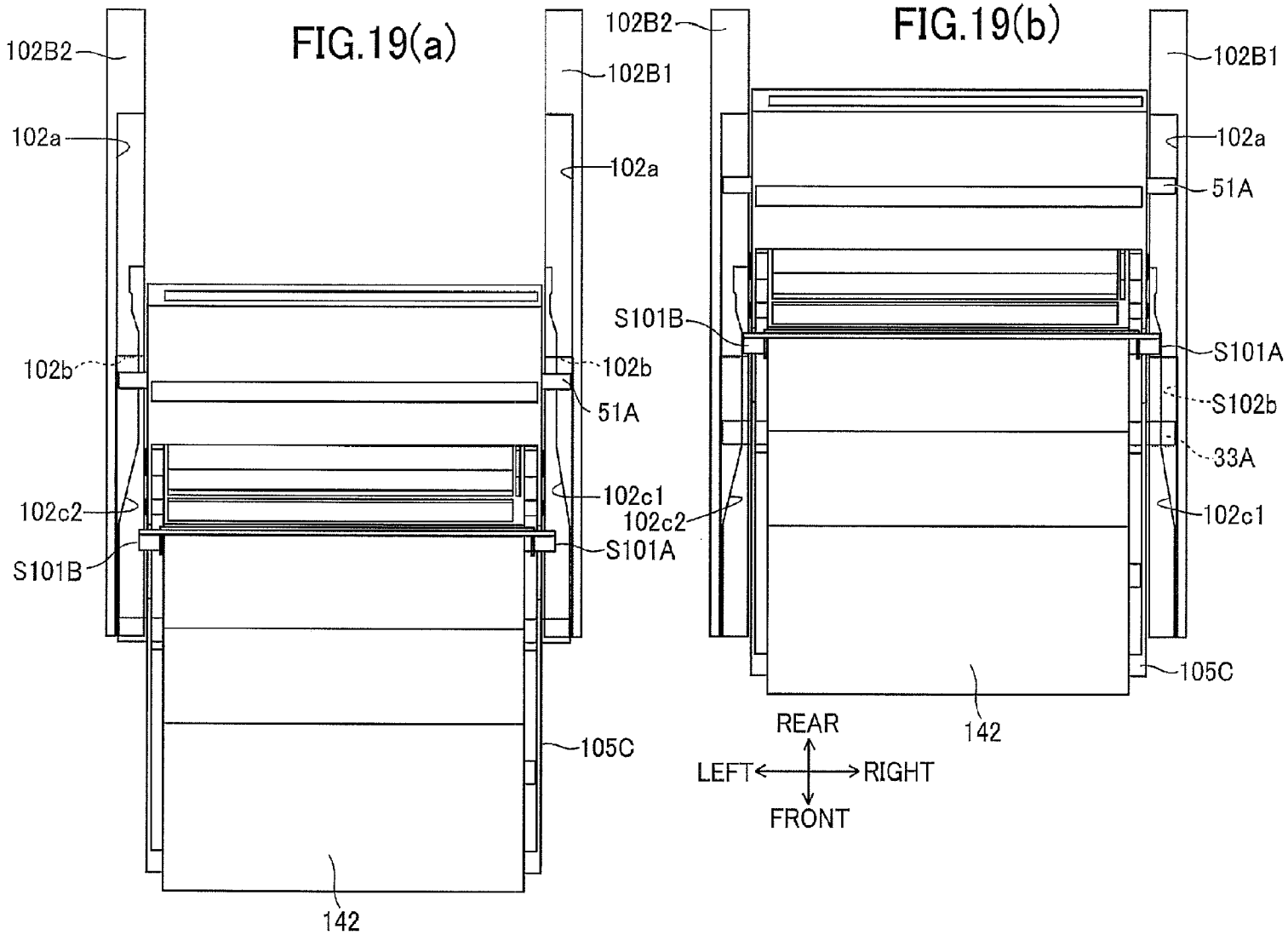
FIG. 19(*a*) is a view for description of movement of the first shutter and showing an initial state of insertion of the process cartridge into a main frame in the laser printer according to the second embodiment.
Figure 19D:
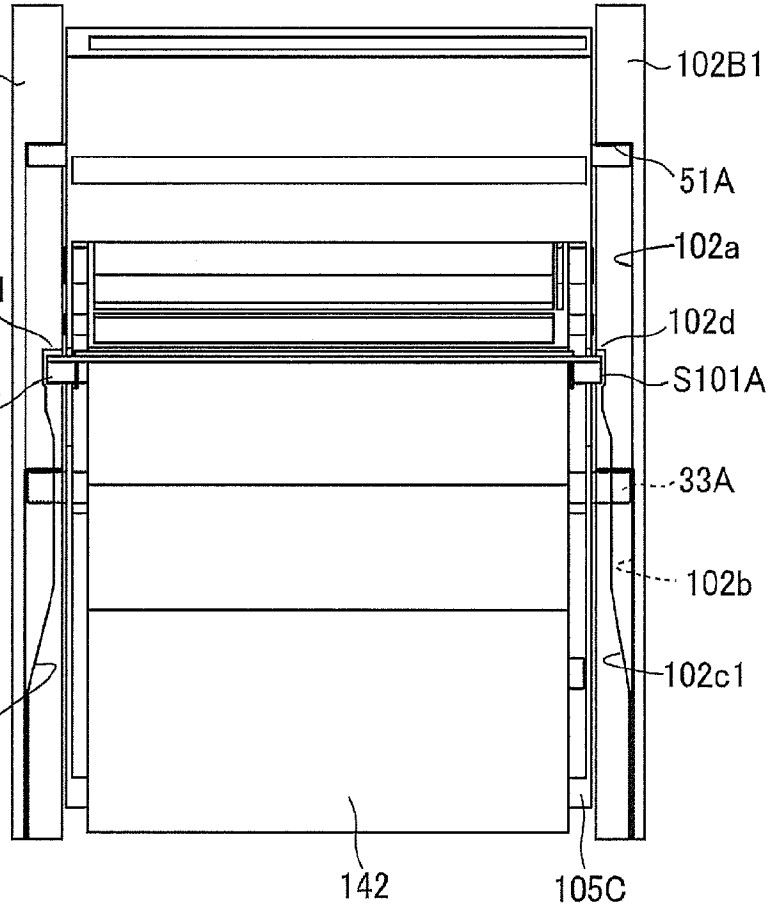
Figure 19C:
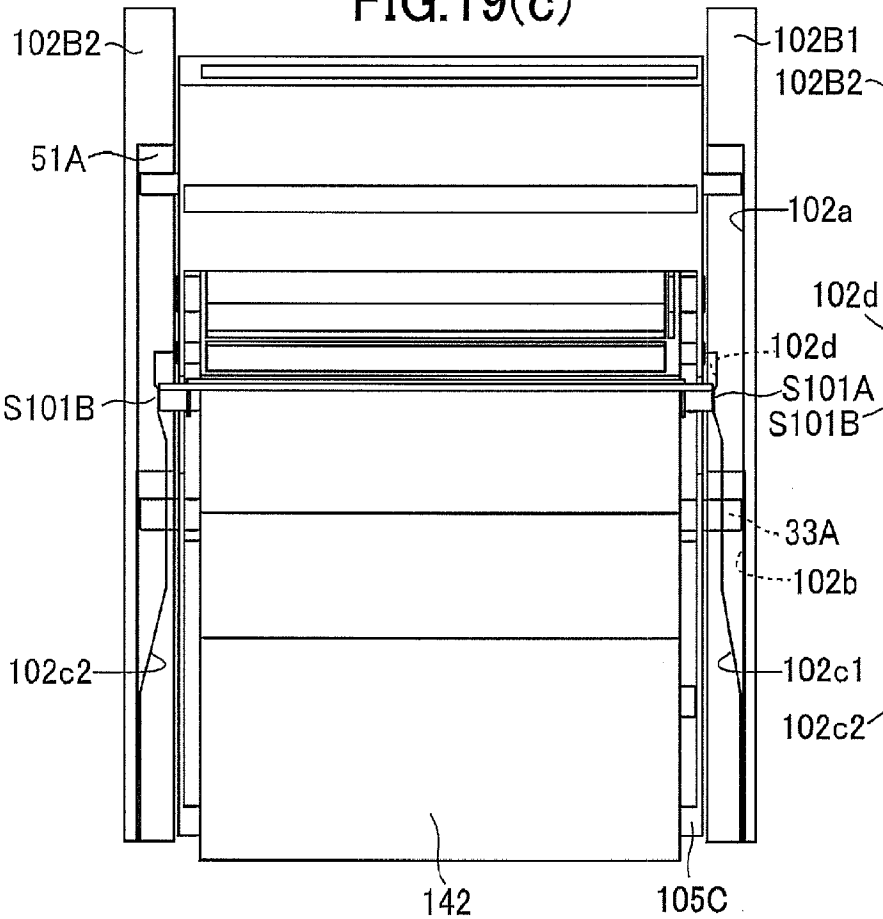

Further, each guide wall section 102B is formed with a shutter guide groove 102*c* including a right shutter guide groove 102*c*1 and a left shutter guide groove 102*c*2 for guiding movement of a first shutter S101 (described later). As shown in FIGS. 19(*a*) through 19(*d*), depth of the shutter guide groove 102*c* in the lateral direction is changed, and further, the right and left shutter guide grooves 102*c*1 and 102*c*2 have depth and configuration different from each other. The right shutter guide groove 102*c*1 is adapted to move the first shutter S101 from its closed position to its open position in accordance with the loading movement of the process cartridge 142 into the main frame 102, and the left shutter guide groove 102*c*2 is adapted to move the first shutter S101 from its open position to its closed position in accordance with the unloading movement of the process cartridge 142 from the main frame 102.

Figure 14A:
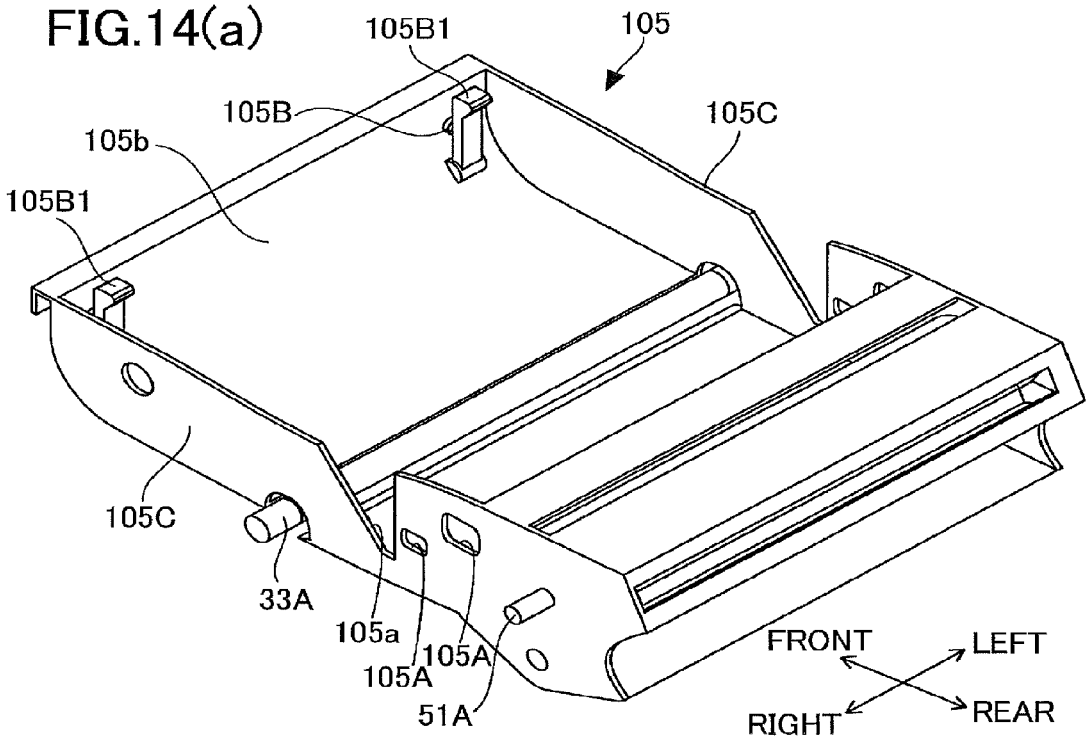
FIG. 14(*a*) is a perspective view of the drum cartridge according to the second embodiment of the invention.
Figure 14B:
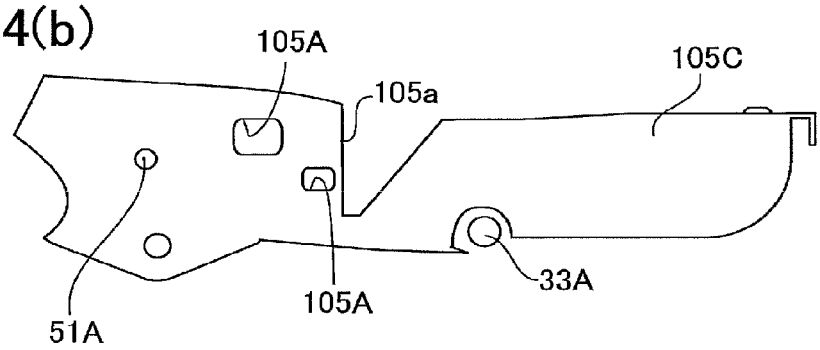
Figure 14C:
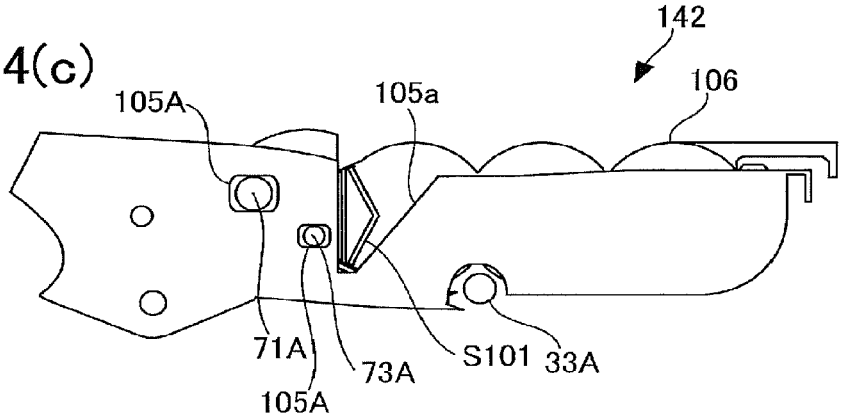

As shown in FIGS. 13, and 14(*a*) through 14(*c*), the drum cartridge 105 accommodates therein the photosensitive drum 51 having a drum shaft 51A, the transfer roller 52 and the scorotron charger 53. Further, the drum cartridge 105 rotatably supports the registration roller 33A. The drum cartridge 105 has a pair of side plates 105C formed with slots 105A and generally V-shaped notch 105*a*.

Here, axial end portions of the drum shaft 51A and axial end portions of the registration roller 33A protrude laterally outward from each side frame 105C of the drum cartridge 105. The axial end portions of the drum shaft 51A function as a first pair of protruding portions engageable with the first pair of guide grooves 102*a*, and the axial end portions of the registration roller 33A function as a second pair of protruding portions engageable with the second pair of guide grooves 102*b* for regulating orientation of the drum cartridge 105 during loading and unloading the process cartridge 142 and for defining the complete loading position of the process cartridge 142. The drum shaft 51A and the registration roller 33A function as a leading guide and a trailing guide for loading the process cartridge 142 into the main frame 102, and the drum shaft 51A and the registration roller 33A function as a trailing guide and a leading guide for unloading the process cartridge 142 from the main frame 102.

The drum cartridge 105 defines therein a loading space 105*b* in which the developing unit 106 (assembly of the developing device 107 and the developer cartridge 108) is installed. In the loading space 105*b*, a pair of biasing projections 105B 1 is provided which is biased by springs 105B for biasing the developing unit 106 toward the photosensitive drum 51. As a result of the assembly of the developing unit 106 into the drum cartridge 105, the process cartridge 142 shown in FIG. 12 is provided.

Figure 16A:
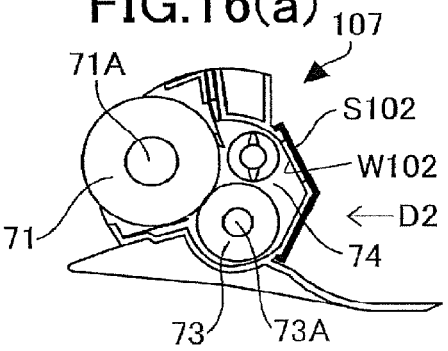
FIG. 16(*a*) is a cross-sectional view of a developing device to be assembled with the developer cartridge according to the second embodiment of the invention.
Figure 16B:
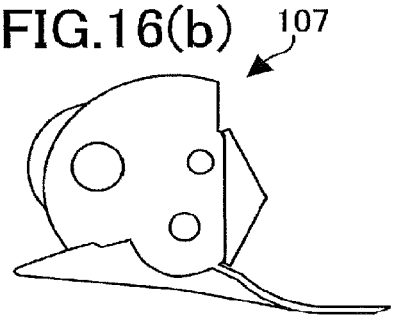

As shown in FIG. 16(*a*), the developing device 107 accommodates therein the developing roller 71 having a roller shaft 71A and the toner supply roller 73 having a roller shaft 73A. Each axial end portions of the roller shafts 71A and 73A is movably supported by the slots 105A. Further, the developing device 107 has a second shutter S102 described later. The developing device 107 is the same as the developing device 7 of the first embodiment except for the configuration of the second shutter S102 and associated case wall part W102 (described later).

As shown in FIGS. 15(*a*) and 15(*b*), the developer cartridge 108 includes first through third toner accommodating portions 181, 182, 183, and first through third agitators A1, A2 and A3. Further as shown in FIG. 15(*c*) the developer cartridge 108 is provided with a gear train including the first agitation gear AG1, second agitation gear AG2, third agitation gear AG3 and gears G for rotating the first through third agitators A1, A2, A3 in a direction indicated by arrows in FIG. 15(*a*). Thus, toner circulation the same as that shown in FIG. 5 can be obtained.

The first toner accommodating portion 181 has a generally V-shaped wall part 181A (W101) corresponding to the first arcuate wall part 81A (W1) of the first embodiment. The first wall part W101 is neighboring to the developing device 107 and protrudes toward an interior of the first accommodating portion 181. More specifically, the first wall part W101 has a first wall region W101A formed with a first through-hole W111 (FIG. 18) allowing communication between an interior of the first accommodating portion 181 and the developing chamber 74, an intermediate wall region W101B, and a second wall region W101C formed with a second through-hole W112 (FIG. 18) allowing communication between the interior of the first accommodating portion 181 and the developing chamber 74.

More specifically, the first wall region W101A has a flat shape and is sloped downward toward a rotation shaft of the first agitator A1, so that the first through-hole W111 is open diagonally downward from the interior of the first accommodating portion 181 to the developing chamber 74. The second wall region W101C has a flat shape, and is sloped upward toward the rotation shaft of the first agitator A1, so that the second through-hole W112 is open diagonally upward from the interior of the first accommodating portion 181 to the developing chamber 74. The second wall region W101C is substantially symmetrically with the first wall region W101A. The intermediate region W101B has an apex shape joining the first wall region W101A and the second wall region W101C. Thus, the intermediate wall portion W101B is positioned closer to the rotation shaft of the first agitator A1 than the first wall region W101A and the second wall region W101C to the rotation shaft. With this arrangement, the second embodiment provides the toner circulation mode the same as that of the first embodiment.

Figure 18A:
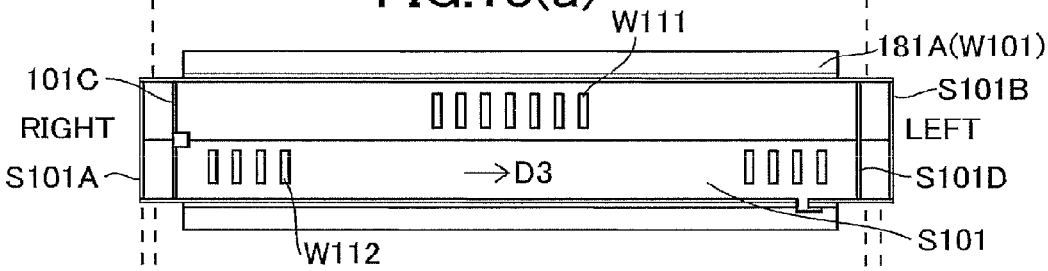
FIG. 18(*a*) is a front view of a first shutter as viewed in a direction of an arrow D1 in FIG. 15(*a*) and particularly showing an open state of first and second through-holes according to the second embodiment of the invention.
Figure 18B:
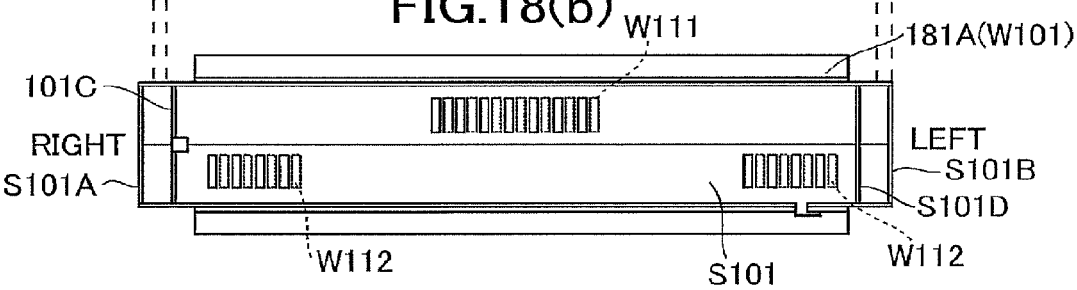

As shown in FIG. 15(*a*), the first shutter S101 has a V-shaped configuration in conformance with the shape of the wall part W101. Further, as shown in FIGS. 18(*a*) and 18(*b*), the first shutter S101 is slidably movable relative to the first wall part W101 in the lateral direction.

Further, the shutter S101 is formed with a first set of plurality of shutter openings in co-operation with the first through-hole W111, and a second set of plurality of shutter openings in co-operation with the second through-holes W112. As shown in FIG. 18(*a*), when the shutter S101 is positioned at most leftward, the first and second set of shutter openings are aligned with the first and second through-holes W111, W112, respectively, to provide open position of the shutter S101. Further, as shown in FIG. 18(*b*), when the first shutter S101 is positioned at most rightward, the first and second set of shutter openings are offset from the first and second through-holes W111, W112, respectively, to provide closed position of the first shutter S101.

Each lateral end portion of the first shutter S101 protrudes laterally outward from each side plate 105C of the drum cartridge 105 through each V-shaped notch 105*a*. Further, rightmost end face S101A and leftmost end face S101B of the first shutter S101 are abutable and in sliding contact with the right shutter guide groove 102*c*1 and left shutter guide groove 102*c*2, respectively, so that the first shutter S101 can be moved leftward and rightward in accordance with the inserting movement and detaching movement of the process cartridge 142, respectively by way of the guidance by the guide grooves 102*c*1, 102*c*2, respectively. The first shutter S101 has a right regulation portion S101C and left regulation portion S101D at a position adjacent to the rightmost end face S101A and leftmost end face S101B, respectively. Further, the first shutter S101 is positioned between the photosensitive drum 51 and the registration roller 33A in the loading and unloading direction of the process cartridge 142 relative to the main frame 102.

The developing device 107 has the case wall part W102 having a generally V-shaped cross-section in conformance with the V-shaped configuration of the first wall part W101. The second shutter S102 has a shape in conformance with the case wall part W102, and is slidably movable in the lateral direction relative to the case wall part W102. The second shutter S102 is positioned in confronting relation to the first shutter S101.

Figure 17A:
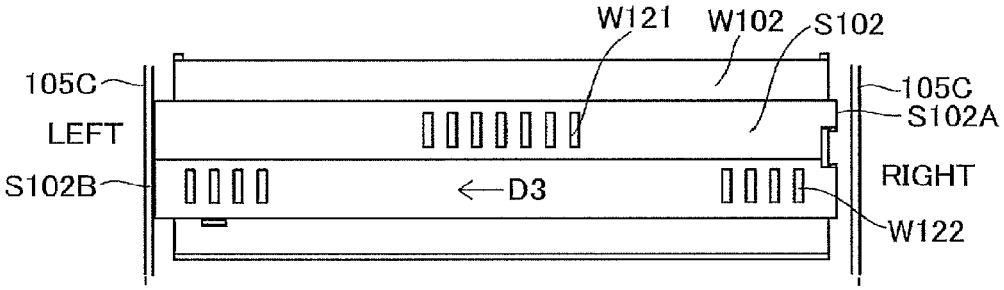
FIG. 17(*a*) is a front view of a second shutter as viewed in a direction of an arrow D2 in FIG. 16(*a*) and particularly showing an open state of third and fourth through-holes according to the second embodiment of the invention.
Figure 17B:
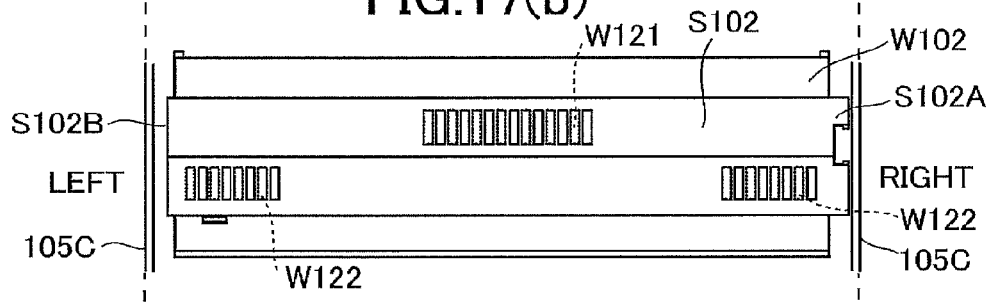

As shown in FIGS. 17(*a*) and 17(*b*), the second shutter S102 has a rightmost end face S102A and a leftmost end face S102B defining a lateral length therebetween, and the lateral length is smaller than a lateral distance between the side plates 105C and 105C of the drum cartridge 105. In other words, the second shutter S102 is laterally movable within a distance defined between the side plates 105C and 105C. The second shutter S102 is formed with a first set of plurality of shutter openings in co-operation with the third through-hole W121, and a second set of plurality of shutter openings in co-operation with the fourth through-holes W122. As shown in FIG. 17(*a*), when the second shutter S102 is positioned at most leftward, the first and second set of shutter openings of the second shutter S102 are aligned with the third and fourth through-holes W121, W122, respectively, to provide open position of the second shutter S102. Further, as shown in FIG. 17(*b*), when the second shutter S102 is positioned at most rightward, the first and second set of shutter openings of the second shutter S102 are offset from the third and fourth through-holes W121, W122, respectively, to provide closed position of the second shutter S102.

The right regulation portion S101C of the first shutter S101 is engageable with the rightmost end face S102A of the second shutter S102, so that the second shutter S102 is laterally movable to its open position when the right regulation portion S101C of the first shutter S101 pushes the rightmost end face S102A of the second shutter S102 in accordance with the leftward movement of the first shutter S101 which is caused by inserting motion of the process cartridge 142 into the main frame 102. Similarly, The left regulation portion S101D of the first shutter S101 is engageable with the leftmost end face S102B of the second shutter S102, so that the second shutter S102 is laterally movable to its closed position when the left regulation portion S101D of the first shutter S101 pushes the leftmost end face S102B of the second shutter S102 in accordance with the rightward movement of the first shutter S101 which is caused by detaching motion of the process cartridge 142 from the main frame 102.

In summary, the second shutter S102 is laterally movable only by the lateral movement of the first shutter S101. This is important for avoiding accidental toner leakage from the developing device 107. In other words, the second shutter S102 is out of interference with the shutter guide grooves 102*c*1, 102*c*2, and therefore, closed position of the second shutter S102 can be maintained as long as the developing device 107 is solely inserted between the guide wall sections 102B and 102B of the main frame 102. The second shutter S102 can only be opened upon the developing device 107 and the developer cartridge 108 are assembled together, and the resultant process cartridge 142 is inserted between the guide wall sections 102B and 102B.

As shown in FIG. 19(*d*) the shutter guide grooves 102*c*1, 102*c*2 have rearmost end portion 102*d* (deepest end portion) where a gap is provided between the rightmost end face S101A of the first shutter S101 and the right shutter guide groove 102*c*1, and between the leftmost end face S101B and the left shutter guide groove 102*c*2. Further, the rearmost end portion has a predetermined length in the frontward/rearward direction to allow the first shutter S101 to be movable toward and away from the photosensitive drum 51 within the stroke of the predetermined length. This gap is important to allow the developing unit 106 to be movable by the biasing force of the spring 105B and the biasing projection 105B 1 so that the developing unit 106 can smoothly follow the movement of the photosensitive drum 51 to ensure a contact between the photosensitive drum 51 and the developing roller 71. That is, the gap is important so as to make the biasing force valid. When first shutter S101 reaches the rearmost end portion 102*d*, loading of the process cartridge 142 into the pair of guide wall sections 102B is completed and the first shutter S101 is maintained at is open state. In this case, if the above-described gap is not provided but the first shutter S101 is securely engaged with the right and left shutter guide grooves 102*c*1, 102*c*2, the secure engagement may affect smooth movement of the developing unit 106 canceling out the biasing force of the spring 105B, which in turn degrades the contact between the photosensitive drum 51 and the developing roller 71. In summary, because of the gap at the rearmost end portions 102*d* and because of the slots 105A, the developing unit 106 (combination of the developer cartridge 108 and the developing device 107) can be moved toward the photosensitive drum 51 by the biasing force of the spring 105B and biasing projection 105B 1.

In operation, the second embodiment performs the toner circulation mode the same as that of the first embodiment as shown in FIG. 5, since the first wall part W101 has the first (upper) wall region W101A having an orientation capable of effectively receiving the toner carried on the first agitator A1. This first wall region W101A corresponds to an upper arcuate region of the first arcuate wall part W1 of the first embodiment. Incidentally, the intermediate wall region W101B corresponds to a vertically intermediate arcuate region of the first arcuate wall part W1 which is closest to the rotation shaft A11 of the first agitator A, and the second (lower) wall region W101C corresponds to a lower arcuate region of the first arcuate wall part W1.

FIG. 19(*a*) shows an initial state of insertion of the process cartridge 142 into the pair of guide wall sections 102B1, 102B2. In this state, the first and second shutters S101, S102 are positioned at their most rightward positions closing the first through fourth through-holes W111, W112, W121, W122. The axially end portions of the drum shaft 51A and the axially end portions of the registration roller 33A are engaged with the first slot 102*a* and the second slot 102*b*, respectively. On the other hand, the rightmost and leftmost end faces S101A, S101B of the first shutter S101 are out of contact from the right and left shutter guide grooves 102*c*1, 102*c*2, respectively.

After the process cartridge 142 is moved rearward from the state shown in FIG. 19(*a*) while being guided by the engagement of the drum shaft 51A and the registration roller 33A with the first and second guide grooves 102*a*, 102*b*, the rightmost end face S101A of the first shutter S101 is gradually moved leftward by the sloping groove bottom of the right shutter guide groove 102*c*1 as shown in FIG. 19(*b*). The leftward movement of the first shutter S101 causes the leftward movement of the second shutter S102 because of the engagement of the right regulation portion S101C of the first shutter S101 with the rightmost end face S102A of the second shutter S102.

After the process cartridge 142 is further moved rearward from the state shown in FIG. 19(*b*), the rightmost end face S101A of the first shutter S101 reaches a highest profile portion of the right shutter groove guide 102*c*1. Thus, the first shutter S101 is at the most leftward position where the first and second through-holes W111, W112 are opened completely as also shown in FIG. 18(*a*). Accordingly, the second shutter S102 is also opened as shown in FIG. 17(*a*) because of the engagement of the right regulation portion S101C with the rightmost end face S102A of the second shutter S102. Incidentally, the left shutter guide groove 102*c*2 is configured such that throughout the leftward movement of the first shutter S101, the left shutter guide groove 102*c*2 does not interfere the movement of the leftmost end face S101B of the first shutter S101.

After the process cartridge 142 is further moved rearward from the state shown in FIG. 19(*c*), the axially end portions of the drum shaft 51 are brought into abutment with the rearmost end of the first guide grooves 102*a* and the axially end portions of the registration roller 33A are brought into abutment with the rearmost end of the second guide groove 102*b*, whereupon loading of the process cartridge 142 onto the pair of guide wall portions 102B is completed as shown in FIG. 19(*d*). In this state, as shown in FIG. 19(*d*), the gap is provided between the rightmost end face S101A of the first shutter S101 and the right shutter guide groove 102*c*1, and between the leftmost end face S101B and the left shutter guide groove 102*c*2 as described above.

For detachment of the process cartridge 142 from the pair of guide wall portions 102B, the left shutter guide groove 102*c*2 is acting on the leftmost end face S101B of the first shutter S101, so that the first shutter S101 can be moved rightward to obtain the closed position of the first shutter S101 as shown in FIG. 18(*b*) and closed position of the second shutter S102 as shown in FIG. 17(*b*) in accordance with unloading movement of the process cartridge 142 from the pair of guide wall sections 102B.

During the loading and unloading process of the process cartridge 142, laterally end portions of the first shutter S101 are always protruding outward of the side plates 105C of the drum cartridge 105 through the V-shaped notches 105*a* formed in the side plates 105C, so that the rightmost and leftmost end faces S101A, S101B can be pressed by the right and left shutter guide grooves 102*c*1, 102*c*2, respectively. Further, during the loading process, the drum shaft 51A is positioned ahead of the first shutter S101, and the registration roller 33A is positioned backward of the first shutter S101. Therefore, orientation of the process cartridge 142 relative to the pair of guide wall portions 102B can be correctly maintained by the axially end faces of the drum shaft 52A and the axially end faces of the registration roller 33A during loading. This prevents the first shutter S101 from accidental lateral movement during loading operation due to diagonal insertion of the process cartridge 142. The diagonal insertion may cause contact between the rightmost end face S101A and the right shutter guide groove 102*c*1 at an improper portion of the right shutter guide groove 102*c*1 causing accidental opening of the first and second shutters S101, S102 prior to complete loading of the process cartridge 142.

The same is true with respect to unloading operation. The registration roller 33A is positioned ahead of the first shutter S101, and the drum shaft 51A is positioned backward of the first shutter S101. Thus, diagonal posture of the process cartridge 142 relative to the pair of guide wall portions 102B can be obviated during unloading movement of the process cartridge 142, so that the shutters S101, S102 can be smoothly moved to their closed positions.

Figure 20A:
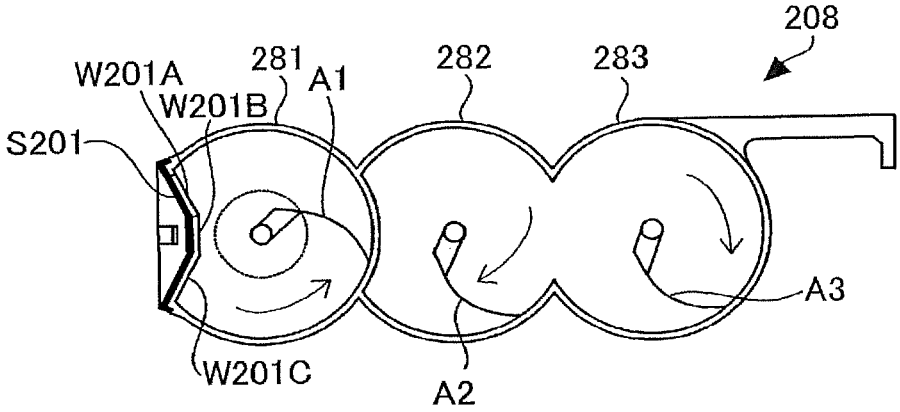
FIG. 20(*a*) is a side view of a developer cartridge according to a modification to the second embodiment.
Figure 20B:
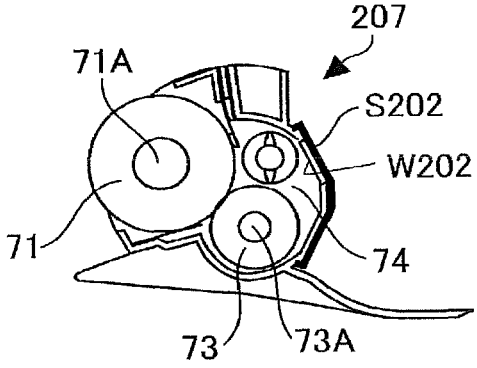

FIG. 20(*a*) shows a modification to the developer cartridge 108 of the second embodiment. According to the modification, a developer cartridge 208 includes the first toner accommodating portion 281 having a first wall part W201. The first wall part W201 is bottom-flat V-shaped instead of V-shaped first wall part W101 of the second embodiment. More specifically, the first wall part W201 includes a first flat wall region W201A similar to the first wall region W101A, an intermediate flat wall region W201B instead of the intermediate apex portion S101B, and a second flat wall region W201C similar to the second wall region W101C. The intermediate flat wall region W201B is formed as if the apex portion S101B of the second embodiment is subjected to chamfering. The developer cartridge 208 has a first shutter 5201 having a configuration in conformance with the first wall part W201.

FIG. 20(*b*) shows a modification to the developing device 107 of the second embodiment. A developing device 207 has a case wall part W202 having a configuration in conformance with that of the first wall part W201 of the developer cartridge 208. Further, a second shutter 5202 has a configuration in conformance with the shape of the case wall part W202. Operation of the first and second shutters 5201 and 5202 is the same as that of the first and second shutters S101, S102 of the second embodiment.

While the invention has been described in detail with reference to the specific embodiment thereof, it would be apparent to those skilled in the art that various changes and modifications may be made therein without departing from the spirit of the invention.

For example, in the above-described embodiments, the first through-hole W11, W111 is positioned higher than the second through-holes W12, W112. However, the second through-holes W12, W112 can be positioned higher than or on a level the same as that of the first through-hole W11, W111. Further, lateral positions of these through-holes and numbers of the through holes are not limited to the above-described embodiment.

Further, instead of the laser printer, the present invention is also available for other image forming device such as a copying machine and a multi-function device.

What is claimed is:

1. An image forming apparatus comprising:

a main frame;

a fixing device;

a drum cartridge including a photosensitive drum;

a developing device comprising a developing chamber and a toner conveying member positioned in the developing chamber;

a developer cartridge including a toner accommodating portion; and a front cover; wherein the fixing device, the photosensitive drum, the developing chamber, the toner accommodating portion and the front cover being arranged in that order in a first direction;

the developing chamber having a convex portion convex in the first direction;

the toner accommodating portion having a portion adjacent to the convex portion and a protruding portion continuous with the portion and protruding in a second direction opposite to the first direction, the protruding portion having a first opening which opens downward and a second opening which is positioned below the first opening and opens upward;

the toner in the toner accommodating portion being conveyed in the second direction and then being downwardly directed into the developing chamber through the first opening; and the toner conveying member being configured to convey the toner flowed into the developing chamber in a third direction crossing the second direction.

2. The image forming apparatus according to claim 1, wherein the toner accommodating portion extends in an axial direction of the photosensitive drum, and the first opening is positioned at a center portion of the toner accommodating portion in the axial direction and the second opening is positioned at least one end portion of the toner accommodating portion in the axial direction.

3. The image forming apparatus according to claim 1, wherein toner is discharged from the toner accommodating portion through the first opening and is returned into the toner accommodating portion through the second opening.

4. The image forming apparatus according to claim 1, wherein the developer cartridge is detachably attached to the developing device.

5. The image forming apparatus according to claim 1, wherein the developer cartridge and the developing device provide in combination a developing unit; and wherein the drum cartridge and the developing unit provide in combination a process cartridge and the process cartridge is detachably attached to the main frame.

6. The image forming apparatus according to claim 1, wherein the portion and the protruding portion constitute in combination a recessed wall recessed inward.

7. The image forming apparatus according to claim 6, wherein the recessed wall has an arcuate shape.

8. The image forming apparatus according to claim 1, further comprising an agitator positioned in the toner accommodating portion and configured to rotate about a rotational axis to agitate toner accommodated in the toner accommodating portion, the rotational axis being disposed at a position lower than the first opening through which the toner is discharged from the toner accommodating portion downward.

9. The image forming apparatus according to claim 1, further comprising a shutter configured to open and close the first opening and the second opening.

* * * * *